US008960419B2

(12) United States Patent
Kennedy et al.

(10) Patent No.: US 8,960,419 B2
(45) Date of Patent: Feb. 24, 2015

(54) BOX CHECK FOR CONVEYOR BELT AND METHOD OF INSTALLATION

(71) Applicant: Kennedy Metal Products & Buildings, Inc., Taylorville, IL (US)

(72) Inventors: William R. Kennedy, Taylorville, IL (US); John M. Kennedy, Taylorville, IL (US)

(73) Assignee: Kennedy Metal Products & Buildings, Inc., Taylorville, IL (US)

( * ) Notice: Subject to any disclaimer, the term of this patent is extended or adjusted under 35 U.S.C. 154(b) by 110 days.

(21) Appl. No.: 13/783,981

(22) Filed: Mar. 4, 2013

(65) Prior Publication Data

US 2014/0246292 A1 Sep. 4, 2014

(51) Int. Cl.
*B65G 21/08* (2006.01)
*E21F 17/00* (2006.01)

(52) U.S. Cl.
CPC ..... *E21F 17/00* (2013.01); *Y10S 198/95* (2013.01)
USPC ..... 198/860.1; 198/950; 405/132

(58) Field of Classification Search
USPC ..... 198/860.1, 861.1, 950; 405/132, 138, 405/144; 299/11
See application file for complete search history.

(56) References Cited

U.S. PATENT DOCUMENTS

| | | | | |
|---|---|---|---|---|
| 4,483,642 | A | 11/1984 | Kennedy et al. | |
| 4,547,094 | A | 10/1985 | Kennedy et al. | |
| 4,820,081 | A | 4/1989 | Kennedy et al. | |
| 4,898,496 | A * | 2/1990 | Pfeiffer et al. | 405/141 |
| 4,911,577 | A | 3/1990 | Kennedy et al. | |
| 5,373,932 | A * | 12/1994 | Stobich et al. | 198/502.1 |
| 5,392,900 | A * | 2/1995 | Sandwall | 198/860.4 |
| 6,379,084 | B1 | 4/2002 | Kennedy et al. | |
| 6,688,813 | B2 | 2/2004 | Kennedy et al. | |
| 6,846,132 | B2 | 1/2005 | Kennedy et al. | |
| 6,955,594 | B2 * | 10/2005 | Kennedy et al. | 454/169 |
| 7,267,505 | B2 | 9/2007 | Kennedy et al. | |
| 8,162,569 | B2 * | 4/2012 | Kennedy et al. | 405/132 |

OTHER PUBLICATIONS

Richwood, Air Stop Box Check System, 2 web pages retrieved from http://www.richwood.com/containment/air-stop-box-check-system, copyright 2011.
Prior art box checks described in paragraph 3 of U.S. Appl. No. 13/783,981.

* cited by examiner

*Primary Examiner* — James R Bidwell
(74) *Attorney, Agent, or Firm* — Senniger Powers LLP

(57) ABSTRACT

A conveyor belt box check for installation in a mine is disclosed. The box check includes first and second generally parallel spaced-apart walls extending across a mine passage. Each of the walls has a conveyor belt aperture sized for receiving the conveyor. In some embodiments, access doors are provided in the first and second walls, and a partition extends between the first and second walls for separating the access doors from the conveyor belt apertures and for forming an air lock between the walls. A method of installing the box check is also disclosed.

28 Claims, 48 Drawing Sheets

STEP 1

STEP 2

STEP 3

STEP 4

STEP 5

STEP 6

STEP 7

STEP 8

STEP 9

STEP 10

STEP 11

STEP 12

STEP 13

STEP 14

STEP 15

STEP 16

STEP 17

STEP 18

STEP 19

STEP 20

STEP 21

STEP 22

STEP 23

STEP 24

STEP 25

STEP 26

STEP 27

STEP 28

BOX CHECK FOR CONVEYOR BELT AND METHOD OF INSTALLATION

FIELD OF THE INVENTION

The present invention generally relates to mine ventilation equipment, and more particularly to apparatus for controlling the flow air past a conveyor belt in a mine.

BACKGROUND OF THE INVENTION

Ventilation of a mine is typically controlled by fans and various structures in the mine that direct air flow for proper ventilation. Such structures include so-called "box checks" which restrict the flow of air past conveyors in the mine. Basically, a box check is a pair of parallel stoppings (walls) that are built across a mine entry. The stoppings are spaced apart a few feet and are basically identical. The space between the walls is the "box". A conveyor belt passes through apertures in the two walls. The apertures should be fairly tight-fitting around the conveyor to limit the air flow through the apertures past the conveyor.

The stoppings of conventional box checks are typically made from concrete blocks, or brattice cloth, or metal panels of the type sold by Kennedy Metal Products and Buildings, Inc. which are jacked into pressure engagement with the roof and floor of a mine passageway. (These panels are described in various patents, including U.S. Pat. Nos. 4,483,642, 4,547,094, 4,820,081, 4,911,577, 6,379,084, 6,688,813, 6,846,132, and 7,267,505.) The stoppings have apertures to allow pass-through of a conveyor. The apertures may be framed with wood or other material to limit the flow of air past the conveyor. Conventional box checks are difficult to build and are easily damaged by things going wrong with the belt (e.g., the belt moving off track and touching the frame; the heap on the conveyor becoming too high; and break-down of the conveyor structure). Further, the performance of such box checks generally fails to meet expectations. That is, they fail to properly limit the flow of air past the conveyor belt.

There is a need, therefore, for an improved box check for a conveyor belt.

SUMMARY OF THE INVENTION

In general, this invention is direct to a box check for a conveyor belt installed in a mine. The box check comprises first and second generally parallel spaced-apart walls extending across a mine passage. Each of the first and second walls comprises a wall frame including horizontal roof and floor beams, vertical beams extending between the roof and floor beams, and stopping panels secured to the wall frame for stopping open areas between the horizontal roof and floor beams. A conveyor belt aperture frame assembly on the wall frame at least partially defines a conveyor belt aperture for receiving the conveyor belt.

In a related embodiment, the box check comprises first and second generally parallel spaced-apart walls extending across a mine passage, each having a conveyor belt aperture sized for receiving the conveyor belt. Access doors are provided in the first and second walls. The box check includes a partition extending between the first and second walls for separating the access doors from the conveyor belt apertures and for forming an air lock between the walls.

This invention is also directed to a method of installing a box check for a conveyor belt in a mine passage. The method comprises installing first and second generally parallel spaced-apart walls to extend across a mine passage. The method is characterized by the following steps for each of the first and second walls: telescopically adjusting horizontal roof and floor beams to fit a width of the mine passage; anchoring the roof and floor beams to a roof and floor of the mine passage, respectively; telescopically adjusting vertical beams to extend between the roof and floor beams to fit a height of the mine passage; bolting two of the vertical beams to the roof and floor beams at selected horizontally-spaced locations on opposite sides of a vertical centerline of the conveyor belt; and bolting horizontal frame members to the two vertical beams such that the frame members extend between the vertical beams at selected vertically-spaced locations to provide a conveyor belt aperture in the wall between the two vertical beams and between the horizontal frame members.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
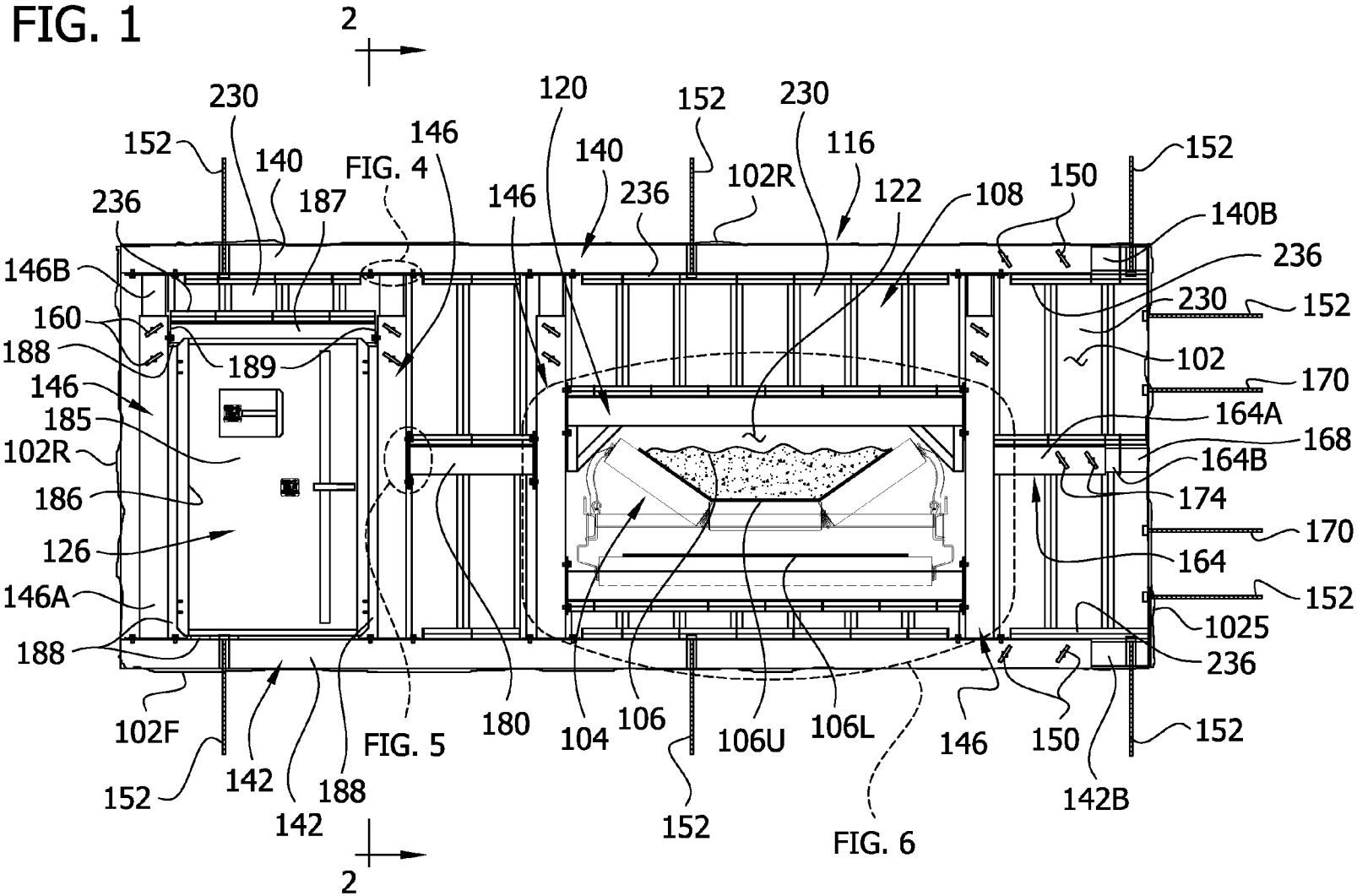
FIG. 1 is a front elevation of a first wall of a conveyor belt box check of this invention.
Figure 2:
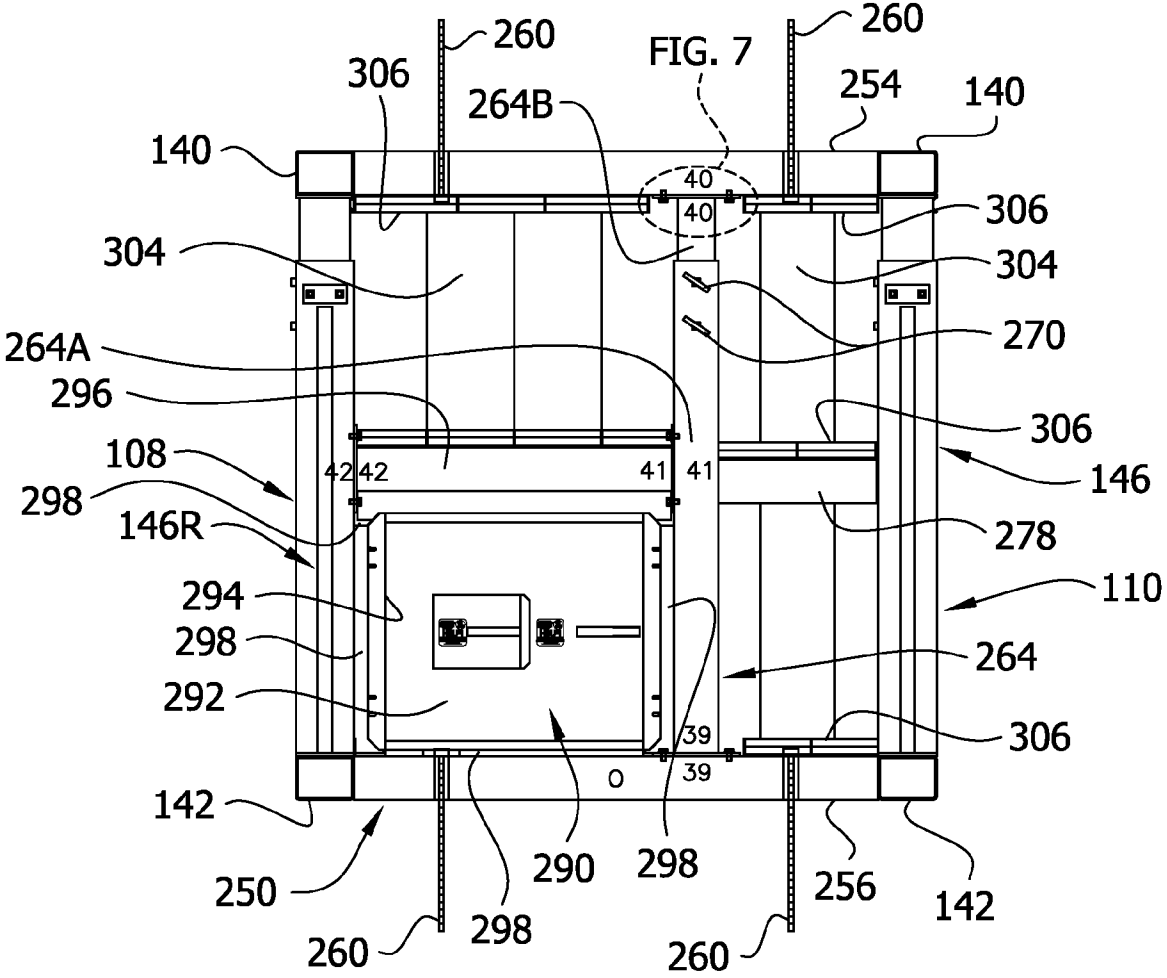
FIG. 2 is a vertical section taken in the plane of lines 2-2 of FIG. 1.
Figure 3:
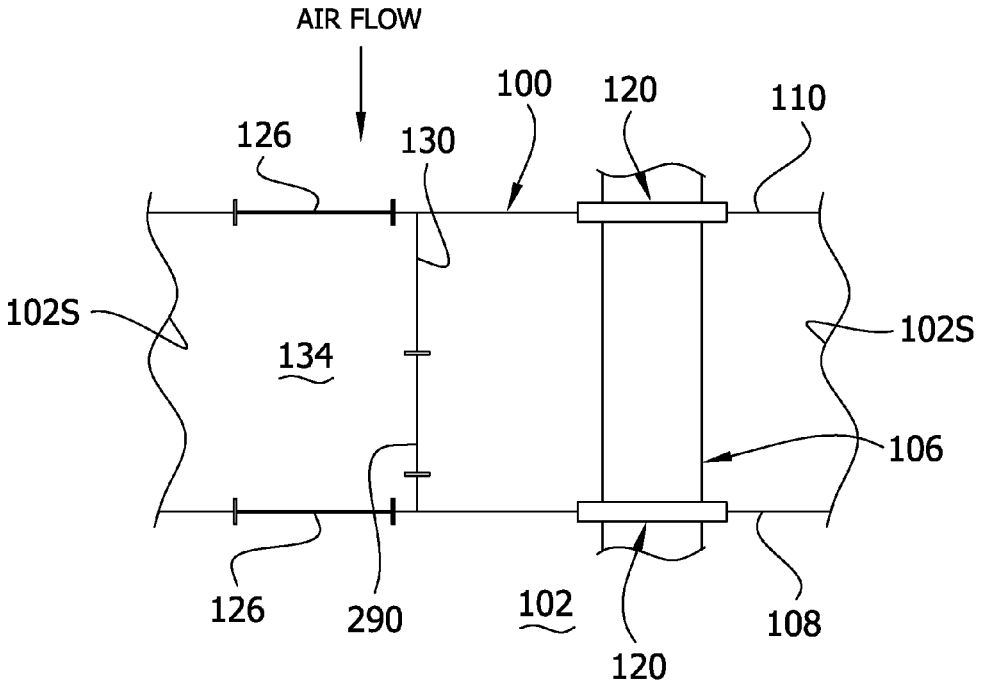
FIG. 3 is a schematic top view of the box check showing the first wall, a second wall, and a partition wall.

Referring now to FIGS. 1-3, a conveyor belt box check, generally designated 100, is shown installed in a mine passage 102 having a roof 102R, a floor 102F, and opposite sides or ribs 102S. The box check 100 is installed around a conveyor belt assembly 104 that includes a conveyor belt 106 having an upper reach 106U for conveying a load (e.g., coal) and a lower (return) reach 104L. In general, the box check comprises first and second generally parallel spaced-apart walls 108, 110 extending across the passage 102. The wall 108 closer to the mouth of the mine is referred to hereinafter as the "outby" wall, and the wall 110 farther away from the mouth of the mine is referred to as the "inby" wall. Each wall 108, 110 includes a wall frame, generally designated 116, and a conveyor belt aperture frame assembly, generally designated 120, on the wall frame at least partially defining a conveyor belt aperture 122 sized for receiving the conveyor belt 106. Access doors 126 (e.g., man doors) are provided in the first and second walls 108, 110. A partition 130 extends between the first and second walls 108, 110 for separating the access doors 126 from the conveyor belt apertures 122 and for forming an airlock 134 between the walls. The various components of the box check 100 are described in detail below.

The wall frame 116 of each wall 108, 110 comprises a horizontal roof beam 140, a horizontal floor beam 142, and a number of (one or more) vertical beams 146 extending between the roof and floor beams. In the illustrated embodiment, the horizontal and vertical beams 140, 142, 146 are length adjustable. The length adjustment of the roof and floor beams 140, 142 allows the width (horizontal dimension) of the wall frame 116 to be adjusted to fit the width of the mine passage 102, i.e., the distance between the ribs 102S at opposite sides of the mine passage. The length adjustment of the vertical beams 146 allows the height (vertical dimension) of the wall frame 116 to be adjusted to fit the height of the mine entry, i.e., the distance between the roof 102R and floor 102F of the mine passage.

In particular, the length-adjustable roof beam 140 comprises an outer roof beam member 140A and an inner roof beam member 140B having a telescoping fit in the outer roof beam member. The roof beam 140 has end plates 141 at opposite ends of the beam. Similarly, the length-adjustable floor beam 142 comprises an outer floor beam member 142A and an inner floor beam member 142B having a telescoping fit in the outer floor beam member. The floor beam 142 has end plates 143 at opposite ends of the beam. Each roof and floor beam is held in a length-adjusted position by one or more locking devices e.g., T-handle set screws 150 threaded through the wall of the outer beam member and into friction engagement with the wall of the inner beam member received in the outer beam member. The locking devices 150 are designed to yield and permit telescoping movement of the beam members relative to one another in the event of a mine convergence or expansion, thus avoiding damage to the wall frame.

The roof and floor beams 140, 142 are secured to the roof 102R and floor 102F, respectively, by suitable means, such as anchor bolts 152 (FIG. 1) extending through holes in the end plates 141, 143 of the beams in a manner that will be understood by those skilled in this field.

Figure 4:
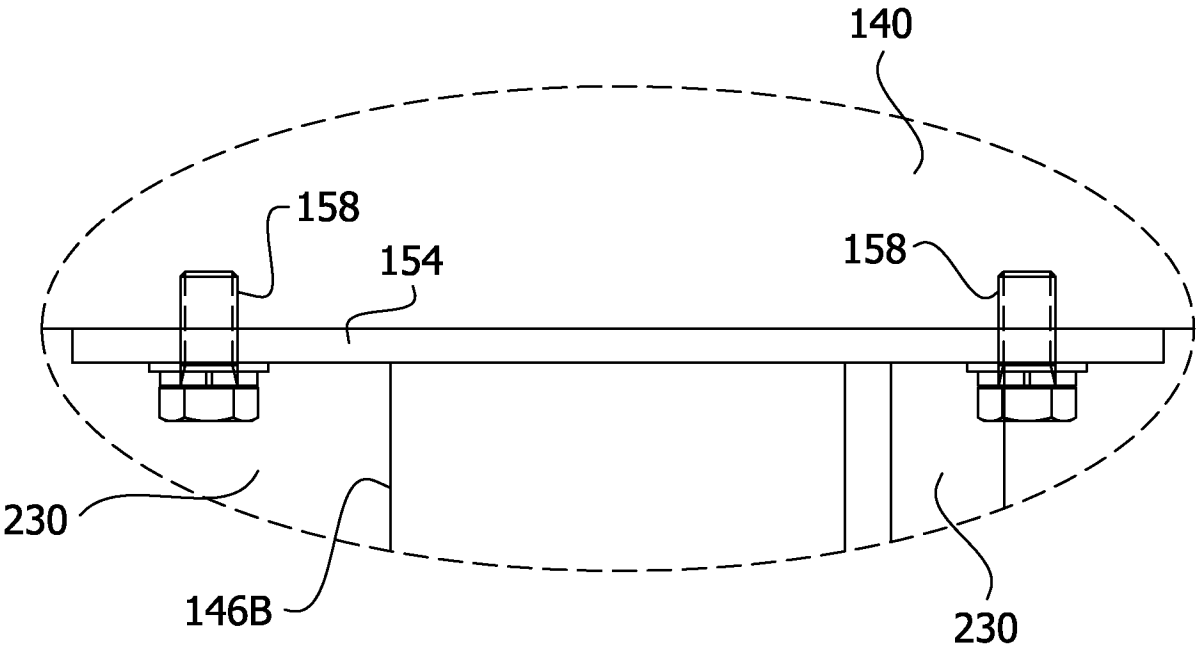
FIG. 4 is an enlarged view of a portion of FIG. 1 showing the attachment of a vertical beam to a roof beam of the box check.

Each vertical beam 146 includes an outer vertical beam member 146A and an inner vertical beam member 146B having a telescoping fit relative to one another. The beam has end (anchor) plates 154 at its upper and lower ends. The end plates 154 are secured to the roof and floor beams 140, 12 by bolts 158 (FIG. 4). Desirably, the roof and floor beams 254, 256 have pre-drilled bolt holes arranged in suitable bolt-hole patterns (matching the bolt-hole patterns in the end plates 154 of the vertical beams 146) spaced at intervals along the lengths of the roof and floor beams. This arrangement facilitates assembly of the wall frame 116 on site and provides flexibility in placing the vertical beams 146 at locations best suited for a particular conveyor belt installation. Alternatively, suitable bolt holes may be drilled in the field at the time of installation. Other means for attaching the vertical beams to the roof and floor beams may be used, such as welding or alternative connecting devices.

Each vertical beam 146 is held in a length-adjusted position by one or more locking devices 160, e.g., T-handle set screws threaded through the wall of the outer beam member 146A and into friction engagement with the wall of the inner beam member 146B received in the outer beam member. The locking devices 160 are designed to yield and permit telescoping movement of the beam members relative to one another in the event of a mine convergence or expansion, thus avoiding damage to the wall frame.

As illustrated in FIG. 1, a length-adjustable horizontal beam 164 is attached (e.g., welded) to the vertical beam 146 adjacent the right rib 102S of the mine passage. The beam 164 comprises telescoping outer and inner beam members 164A, 164B. An end plate assembly 168 on the inner beam member engages the rib 102S of the mine passage and is secured in place by anchor bolts 170. The outer and inner beam members 164A, 164B are held in a length-adjusted position by one or more locking devices 174, e.g., T-handle set screws threaded through the wall of the outer beam member and into friction engagement with the wall of the inner beam member received in the outer beam member.

Figure 5:
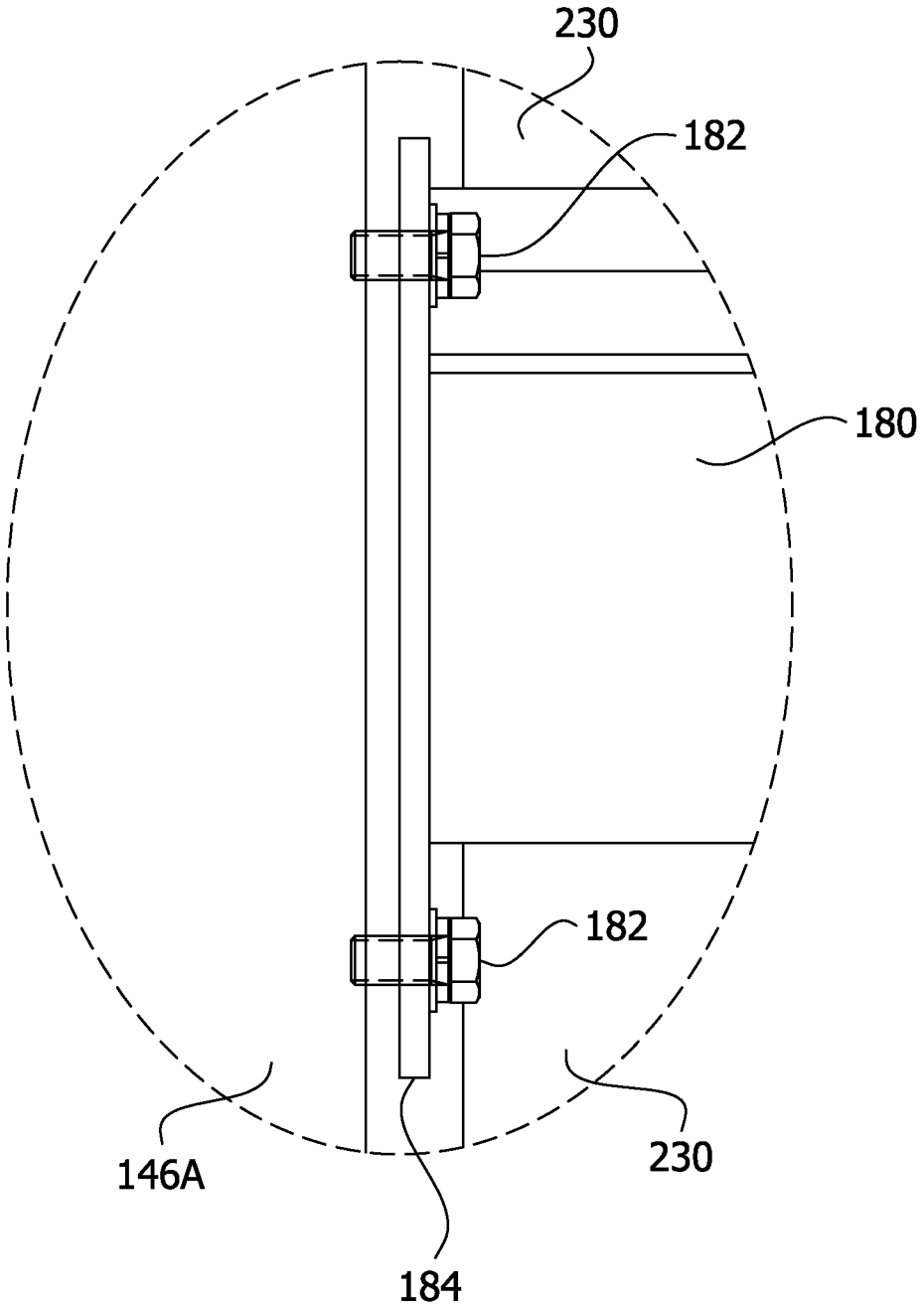
FIG. 5 is an enlarged view of a portion of FIG. 1 showing the attachment of a horizontal beam to a vertical beam of the box check.

For added frame strength, the wall frame 116 includes a horizontal beam 180 at the location indicated in FIG. 1. The beam 180 is secured between two of the vertical beams 146 by bolts 182 extending through end plates 184 at the ends of the beam (see FIG. 5). Additional horizontal beams may be provided as needed or desired.

Other length-adjustable roof, floor, and vertical beam constructions are possible. Further, in other embodiments, some or all of the roof beams, floor beams, and vertical beams are of fixed length (i.e., not length adjustable).

Referring again to FIG. 1, the access door 126 comprises a door panel 185 mounted on a door frame 186 for swinging movement between open and closed positions. The door frame 186 is mounted between two of the vertical beams 146, immediately above the floor beam 142, and below a horizontal lintel beam 187 extending between the two vertical beams. The door frame 186 is secured in place by tongues 188 on the four beams 146, 142, 185 received in respective grooves (not shown) in the door frame. The door frame may be secured in place by other means. The horizontal lintel beam 187 has end plates 189 that are secured (e.g., bolted) to respective vertical beams 146.

Figure 6:
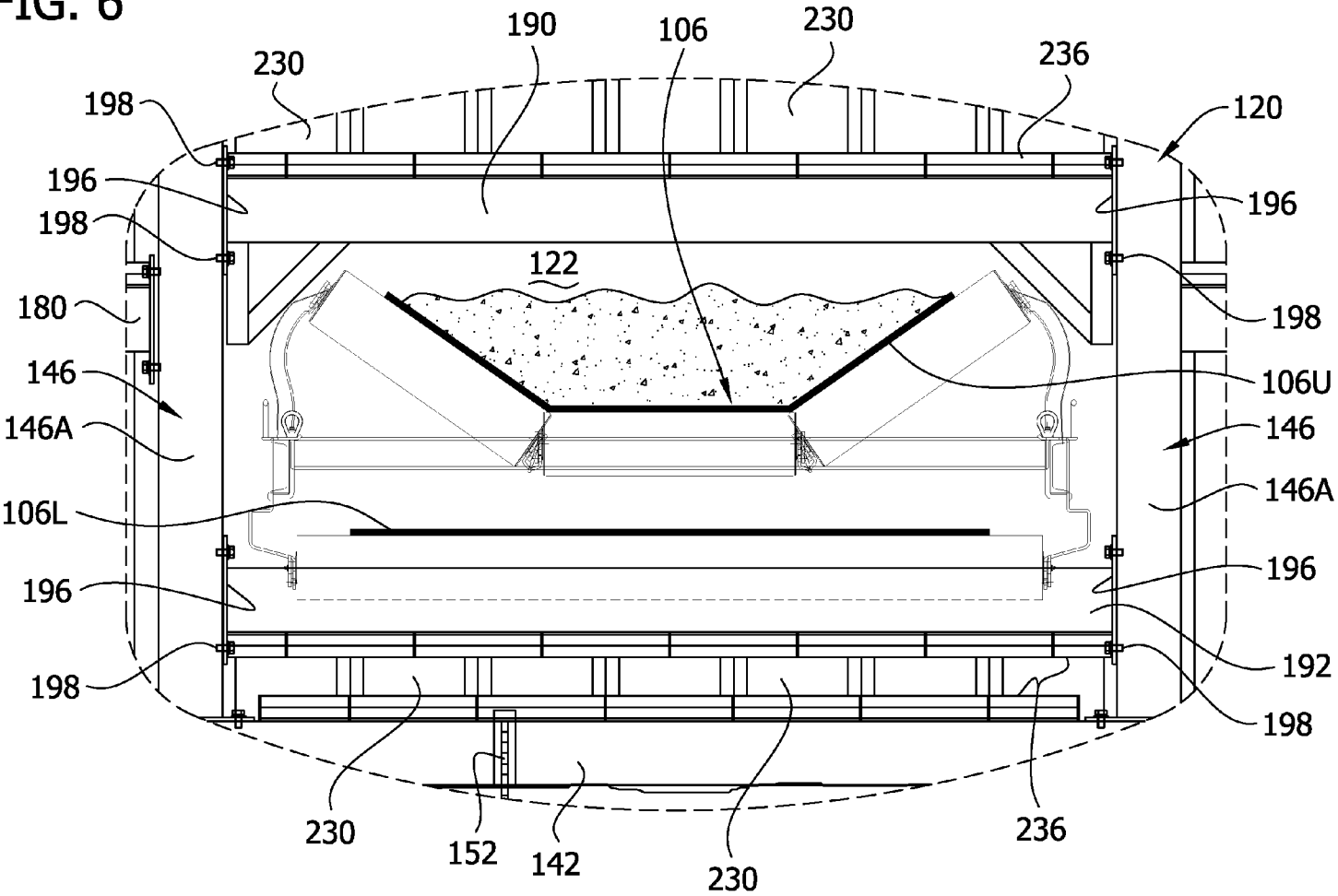
FIG. 6 is an enlarged view of a portion of FIG. 1 showing a conveyor belt aperture frame assembly of the box check.

As shown in FIG. 6, the conveyor belt aperture frame assembly 120 includes two of the vertical beams 146 of the wall frame 116, a first horizontal frame member 190 extending between the two vertical beams, and a second horizontal frame member 192 extending between the two vertical beams at a location spaced below the first horizontal frame member 190. The two vertical beams 146 and the first and second horizontal frame members 190, 192 combine to frame the conveyor belt aperture 122. The horizontal frame members 190, 192 have end (anchor) plates 196 at their opposite ends. The end plates are secured to the vertical beams by bolts 198. Other means for attaching the horizontal beams to the vertical beams may also be used (e.g., welding or other connecting devices).

As will be described in more detail later, the wall frame 116 has multiple pre-drilled bolt holes allowing positioning of the conveyor belt aperture frame assembly 120 at different locations on the wall frame depending on a desired location of the belt aperture 122, and further depending on the dimensions of the belt aperture. This feature facilitates field installation and custom fit of the frame assembly 120 around an existing (or planned) conveyor belt assembly.

Stopping panels 230 are secured to the wall frame 116 of each wall 108, 110 for stopping open areas between the horizontal roof and floor beams 140, 142. By way of example but not limitation, the panels 230 can be of the type sold by Kennedy Metal Products and Buildings, Inc. and disclosed in U.S. Pat. Nos. 4,483,642, 4,547,094, 4,820,081, 4,911,577, 6,379,084, 6,688,813, 6,846,132, and 7,267,505, each of which is incorporated herein by reference for all purposes not inconsistent with this disclosure. In the illustrated embodiment, the panels 230 are elongate and extend vertically in side-by-side relation as shown in FIG. 1. Each of the panels is preferably (but not necessarily) constructed of two panel members having a telescoping fit to allow extension and retraction of the panel members relative to one another to vary the overall length of the panel to fit the openings. The panels are secured by suitable devices (e.g., wire ties or brackets) to angle bars 236 attached, as by welding, to the horizontal beams 140, 142, 164, 180, 190, 192. Reference may be made to the above-referenced patents for further details regarding the telescoping fit of the panel members and the devices for securing the panels 230 to the angle bars 236. The two panel members of each panel are adapted to yield (telescope with respect to one another) during a mine convergence to avoid damage to the panels.

Referring to FIG. 2, the partition 130 comprises a partition frame, generally designated 250, affixed to the wall frames 116 of the first and second walls 108, 110. The partition frame 250 comprises a roof beam 254 attached to the roof beams 140 of the first and second walls 108, 110, and a floor beam 256 attached to the floor beams 142 of the first and second walls. In the illustrated embodiment, the partition roof and floor beams 254, 256 are not length adjustable, but in other embodiments they may be length adjustable, like the roof and floor beams 140, 142 of the two walls 108, 110. The partition roof and floor beams 254, 256 are attached to the roof 102R and floor 102F, respectively, of the passages 102 by suitable means, such as anchor bolts 260 in a manner that will be understood by those skilled in this field.

The partition frame 250 also includes at least one vertical beam 264. In the illustrated embodiment, the vertical beam 264 is length-adjustable and includes an outer vertical beam member 264A and an inner vertical beam member 264B having a telescoping fit with the outer beam member. The vertical beam 264 is held in a length-adjusted position by one or more locking devices 270, e.g., T-handle set screws threaded through the wall of the outer beam member 264A and into friction engagement with the wall of the inner beam member 264B received in the outer beam member. The locking devices 270 are designed to yield and permit telescoping movement of the beam members relative to one another in the event of a mine convergence or expansion, thus avoiding damage to the partition frame.

Figure 7:
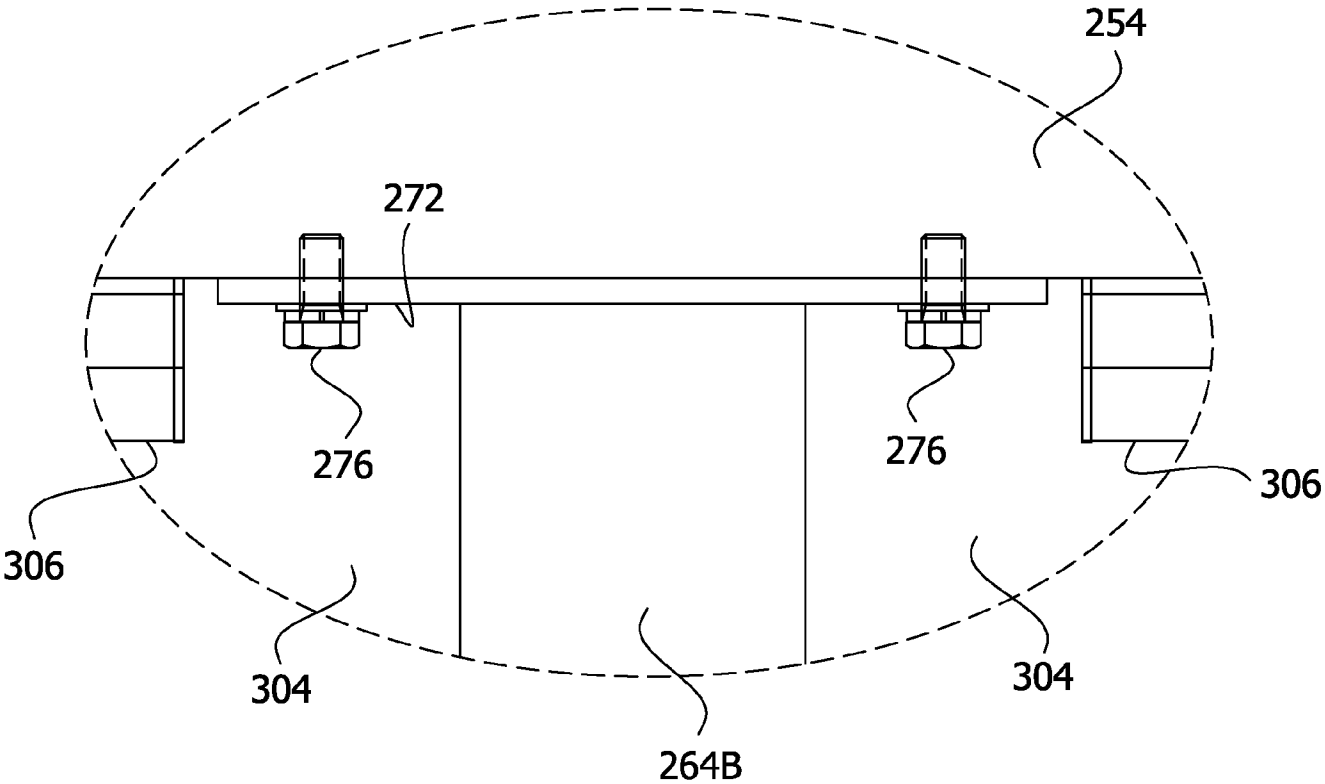
FIG. 7 is an enlarged view of a portion of FIG. 6 showing the attachment of a horizontal frame member to a vertical beam of the conveyor belt aperture frame assembly.
Figures 8, 8A:
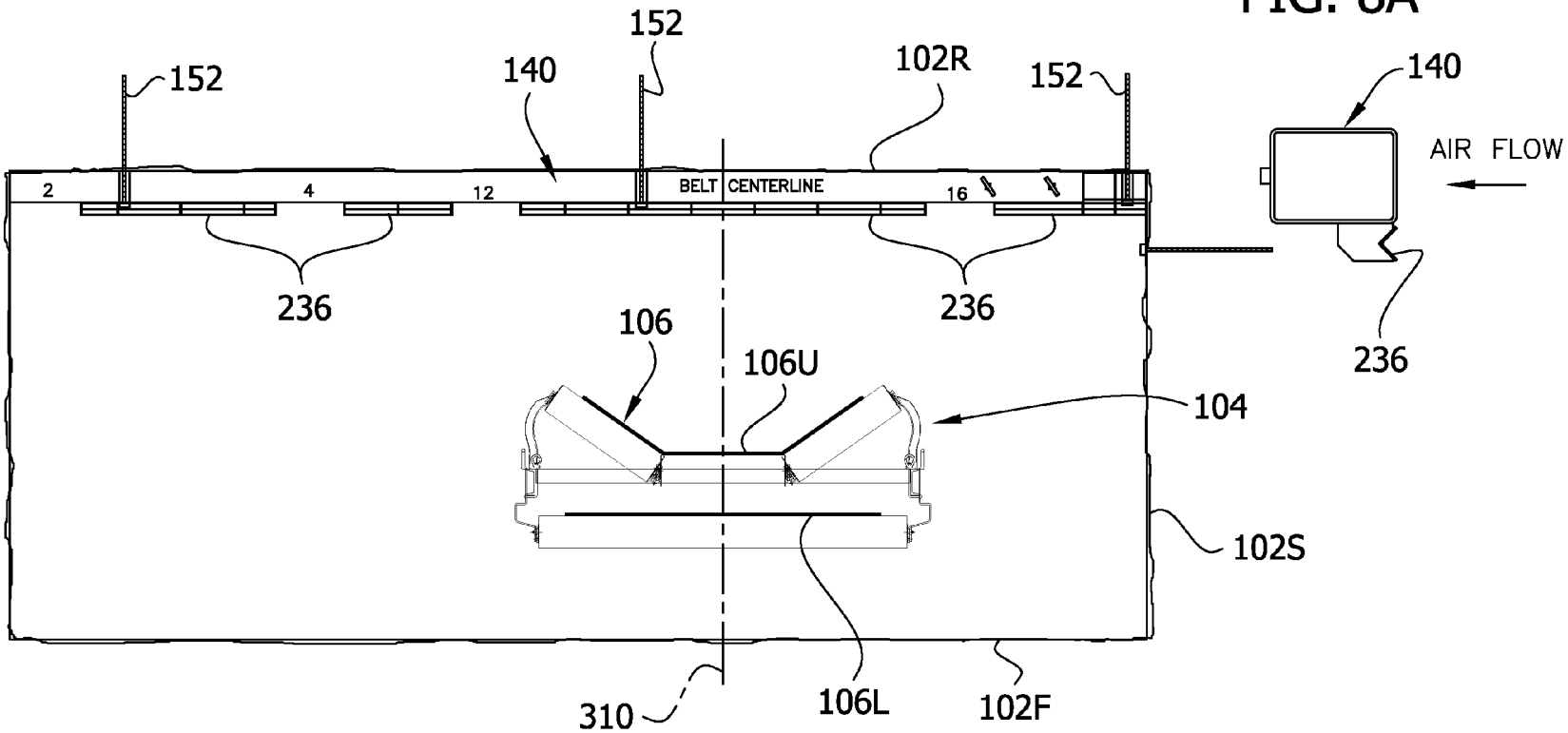
FIGS. 8-35 are views illustrating the steps in the process of installing the box check in a mine passage.

The vertical beam 264 has end (anchor) plates 272 at its upper and lower ends. The end plates 272 are secured to respective partition roof and floor beams 254, 256 by bolts 276 (see FIG. 7). Desirably, the partition roof and floor beams 254, 256 have pre-drilled bolt holes arranged in suitable bolt-hole patterns matching the bolt-hole patterns in the end plates 272 of the partition vertical beam 264. Optionally, multiple bolt-hole patterns can be spaced at horizontal intervals along the lengths of the partition roof and floor beams 254, 256. This arrangement facilitates assembly of the partition frame 250 on site and provides flexibility in placing the vertical beam 264 at a location best suited for a particular conveyor belt installation. Alternatively, suitable bolt holes may be drilled in the field at the time of installation. Other means for attaching the vertical beam 256 to the partition roof and floor beams may also be used, such as welding or alternative connecting devices.

For added frame strength, a horizontal beam 278 is provided at the location shown in FIG. 2.

Again referring to FIG. 2, an access door 290 is mounted on the partition frame 250 for accessing the conveyor belt 106 from inside the airlock 134. The access door 290 comprises a door panel 292 mounted on a door frame 294 for swinging movement between open and closed positions. The door frame 294 is mounted between a vertical beam 146 of the outby wall frame 116 and the vertical partition beam 264, immediately above the partition floor beam 256, and below a horizontal lintel beam 296 extending between the two vertical beams 146, 264. The door frame 294 is secured in place by tongues 298 on the four beams 146, 264, 256, 296 received in respective grooves (not shown) in the door frame 294. The door frame may be secured in place by other means. The horizontal lintel beam 296 has end plates 300 that are secured (e.g., bolted) to the vertical beams 146, 264.

Stopping panels 304 are secured to the partition wall frame 250 for stopping open areas between the partition roof and floor beams 254, 256. These stopping panels 304 are identical in construction to the wall frame stopping panels 230 described above. The stopping panels 304 are secured by suitable devices (e.g., wire ties or brackets) to angle bars 306 attached, as by welding, to the horizontal beams 254, 256, 280, and 296.

The purpose of the partition 130 is to isolate the pressure from the airlock 134 in high pressure differential box check applications. In an installation where the differential pressure across the box check is low, the partition may not be needed.

In a high-differential application, the absence of a partition would result in a large flow of air through an access door 126 when it is opened. The large flow is undesirable because of both the air loss it creates and because it would be difficult to get through the door when a large flow is present.

In general, a method of this invention for installing a box check 100 of the type described above comprises installing first and second generally parallel spaced-apart walls (e.g., walls 108, 110) to extend across the mine passage 102. The method also includes, for each of the first and second walls, telescopically adjusting horizontal roof and floor beams (e.g., roof and floor beams 140, 142) to fit a width of the mine passage; anchoring the roof and floor beams to a roof and floor of the mine passage, respectively; telescopically adjusting vertical beams (e.g., vertical beams 146) to extend between the roof and floor beams, to fit a height of the mine passage; bolting two of the vertical beams to the roof and floor beams at selected horizontally-spaced locations on opposite sides of a vertical centerline of the conveyor belt; and bolting horizontal frame members (e.g., horizontal beams 190, 192) to the two vertical beams such that the frame members extend between the vertical beams at selected vertically-spaced locations to provide a conveyor belt aperture (e.g., aperture 122) in the wall between the two vertical beams and between the horizontal frame members.

In the embodiment described above, the method also includes the step of installing access doors (e.g., access doors 126) in the first and second walls, and the additional step of installing a partition (e.g., partition 130) between the first and second walls for separating the access doors from the conveyor belt apertures and for forming an airlock (e.g., air lock 134) between the walls.

An exemplary method of installing the box check 100 is described in more detail in FIGS. 8-35 illustrating steps 1-28 of the method. These steps are described below.

In step 1 (FIGS. 8 and 8A, FIG. 8A being a right end view of the roof beam 140 of FIG. 8), the roof beam 140 of the outby wall 108 is installed using anchor bolts 152. The open sides of the angle bars 236 on the roof beam should face the high-pressure air flow. The vertical centerline 310 of the belt conveyor 106 should be vertically aligned with a centerline mark 312 on the roof beam 140 to insure that there is adequate belt-to-frame clearance in later steps. The roof beam 160 has bolt patterns indicated at 2, 4, 12, and 16 spaced at horizontal intervals along its length.

Figure 9A:
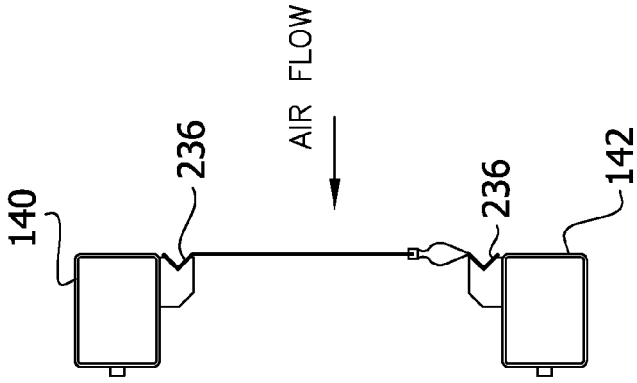
Figure 9:
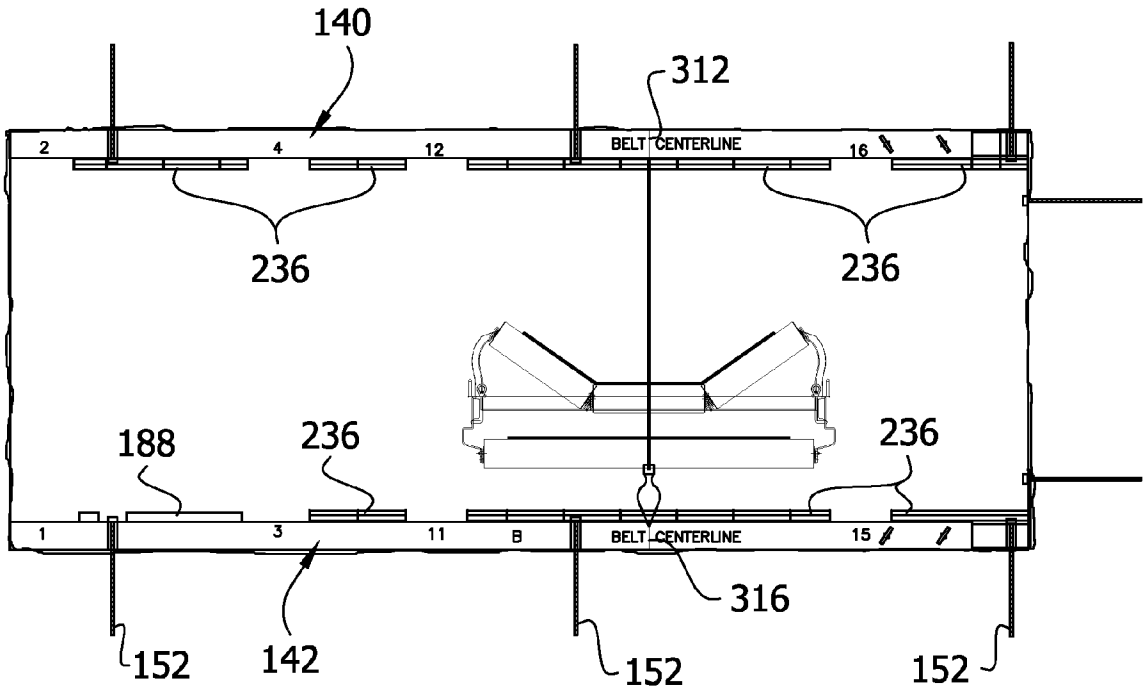
Figure 10:
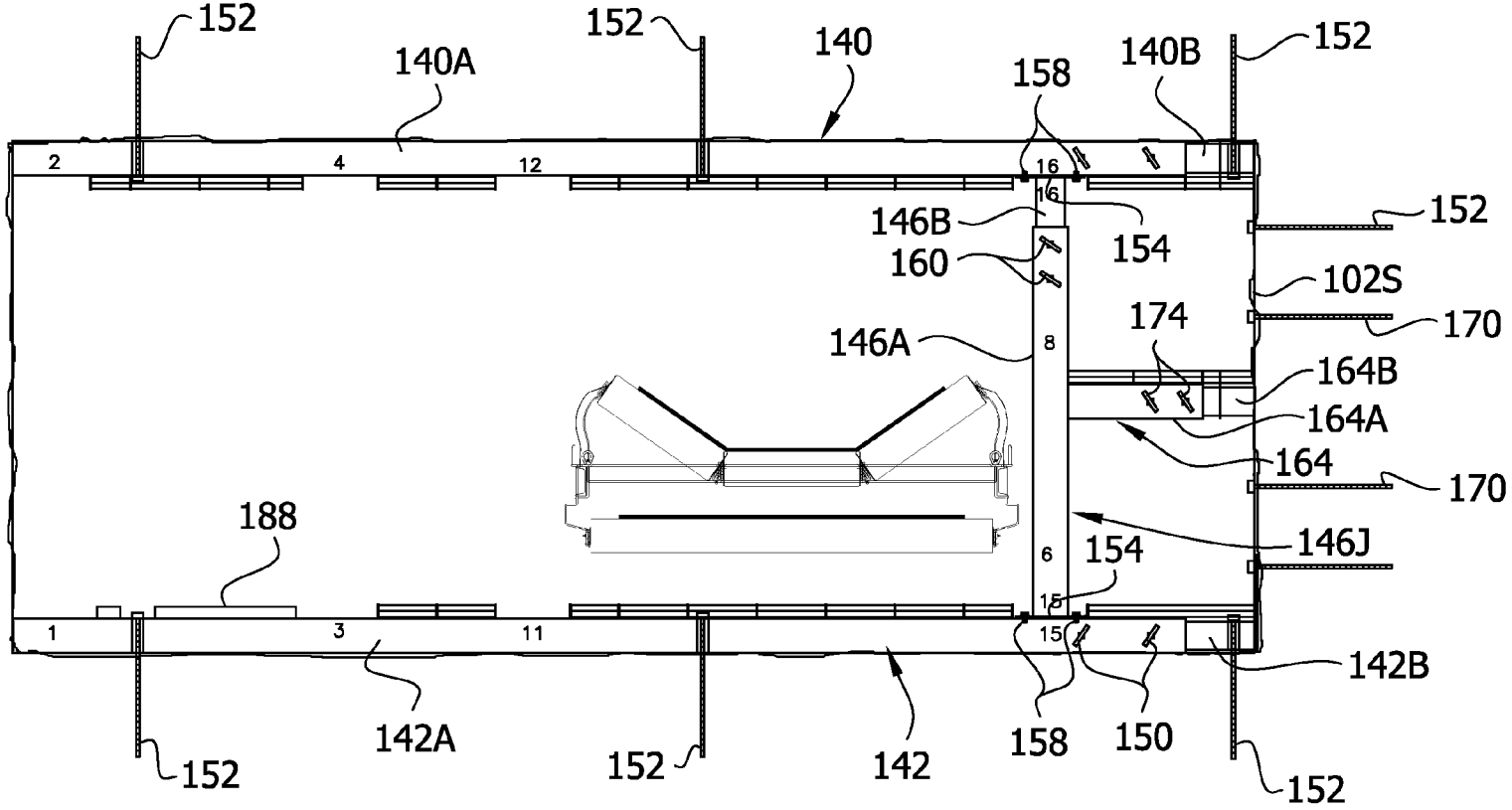
Figure 11:
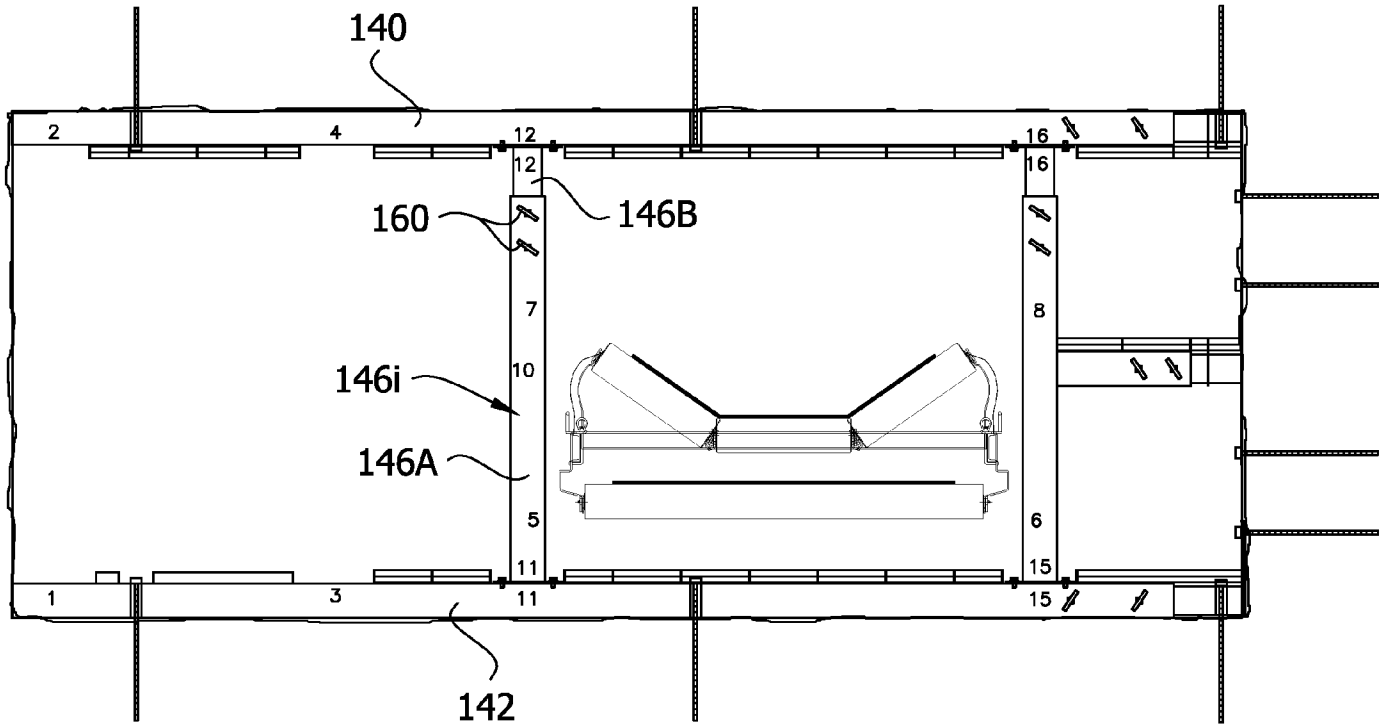
Figure 12:
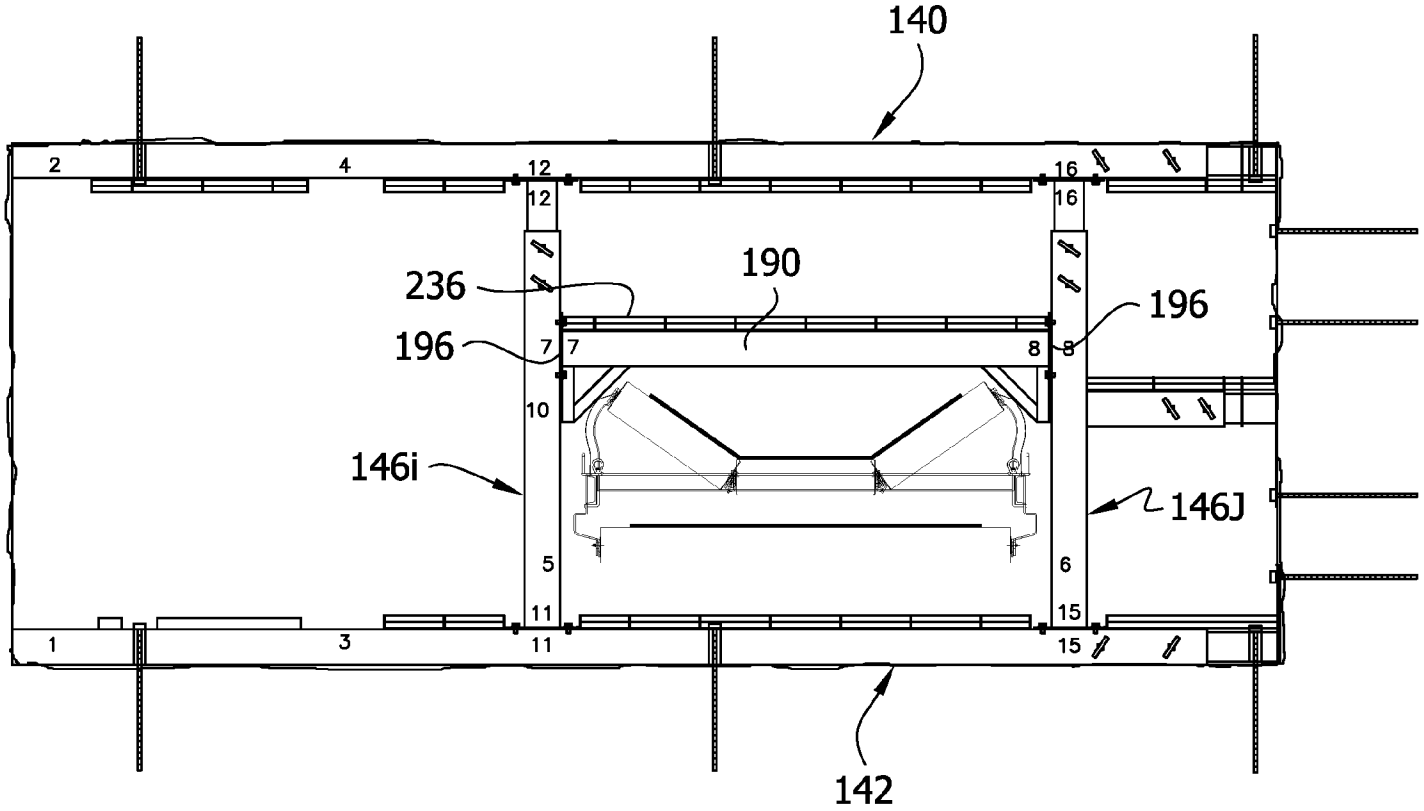
Figure 13:
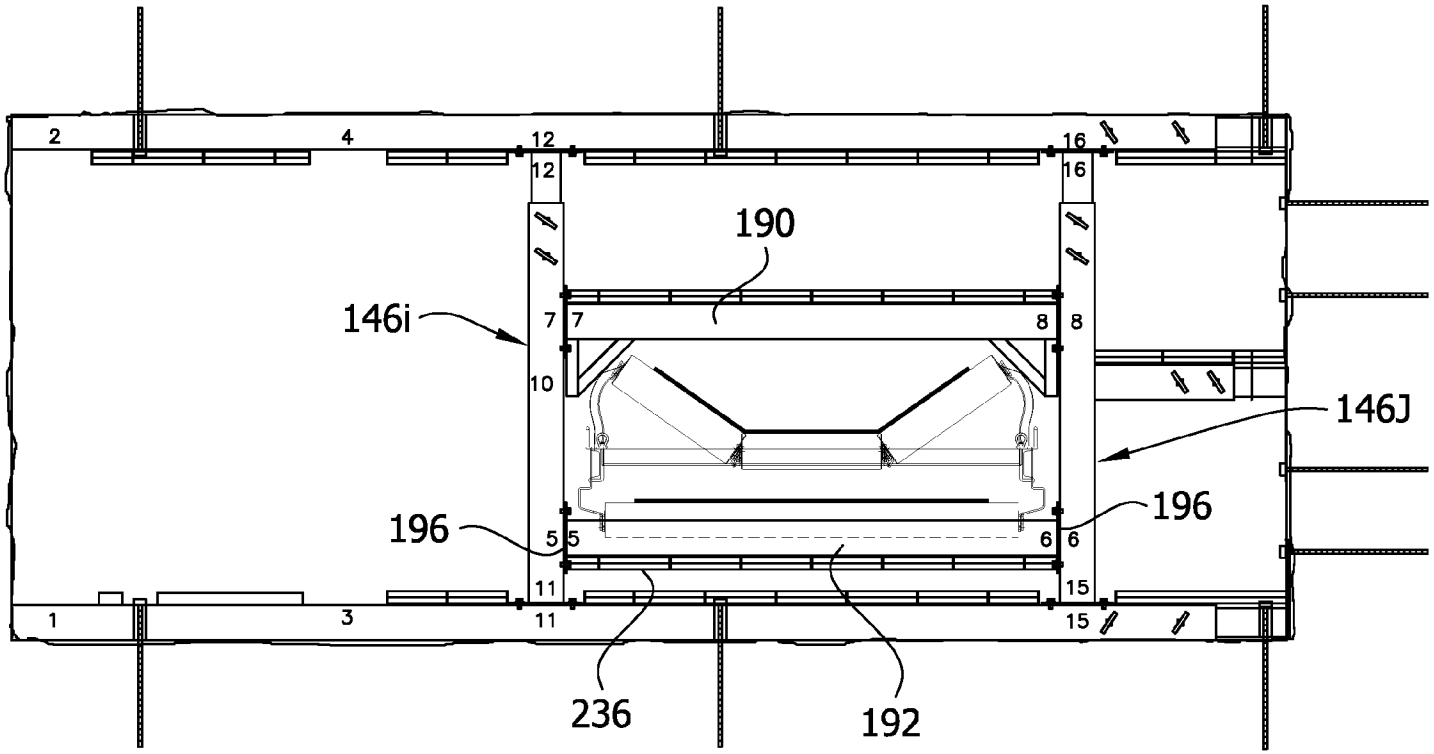
Figure 14:
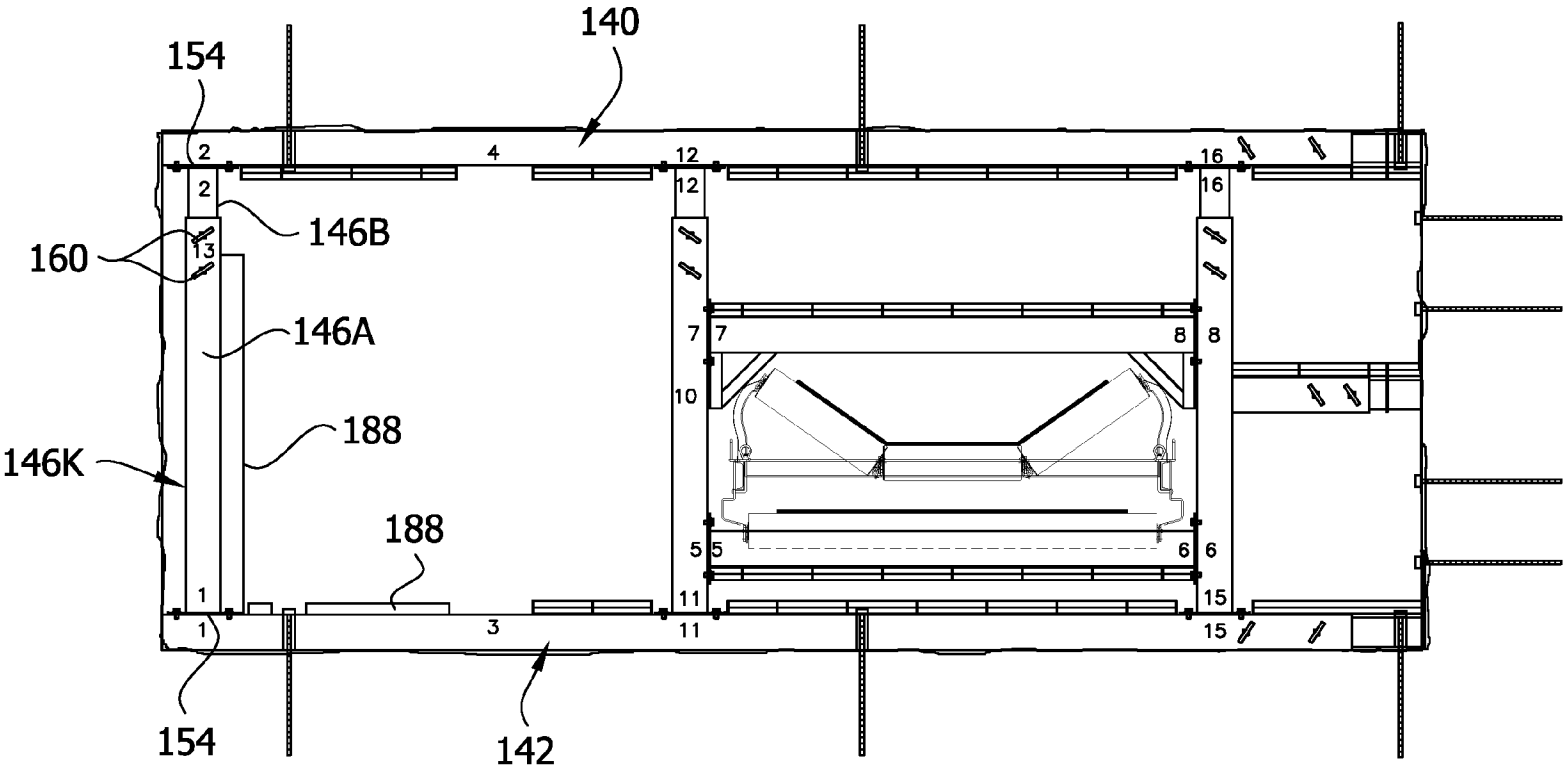
Figure 15:
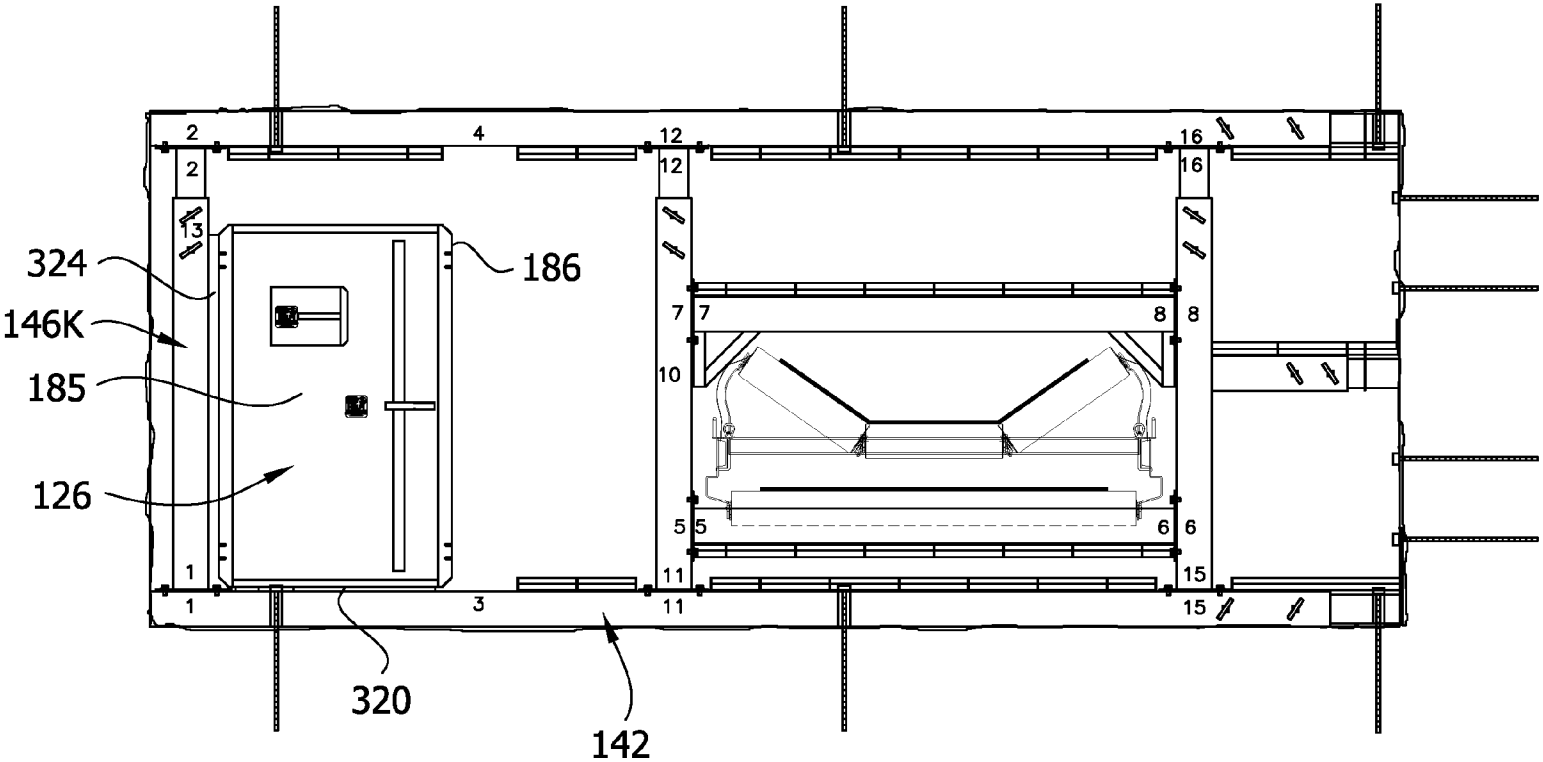
Figure 16:
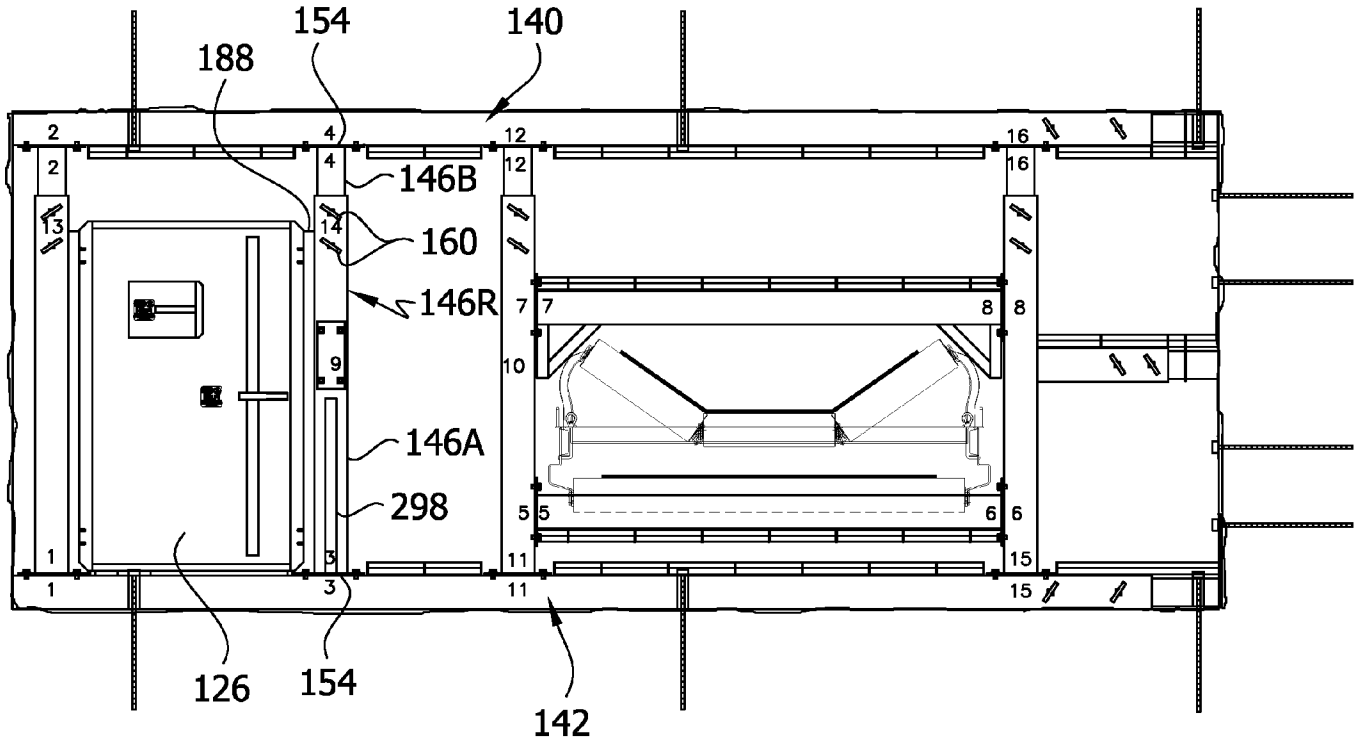
Figure 17:
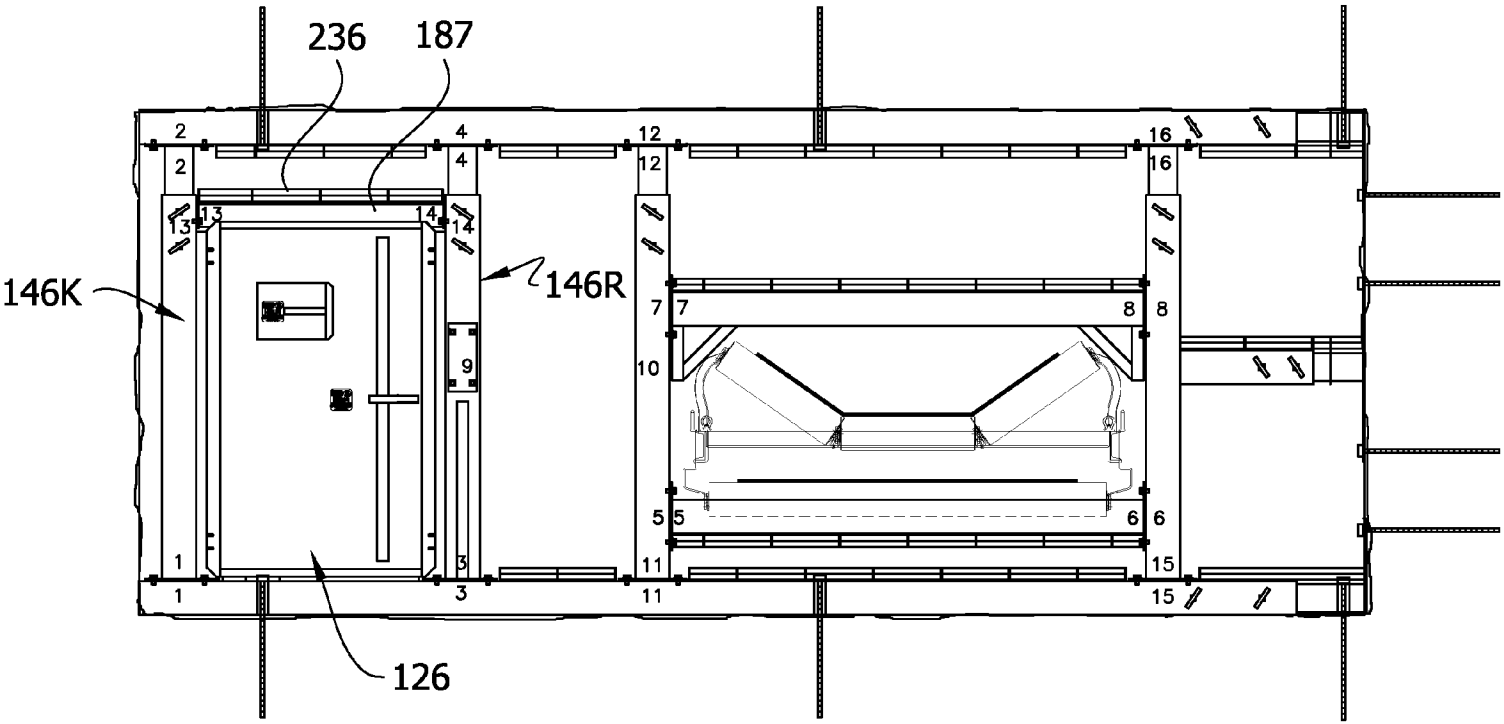
Figure 18:
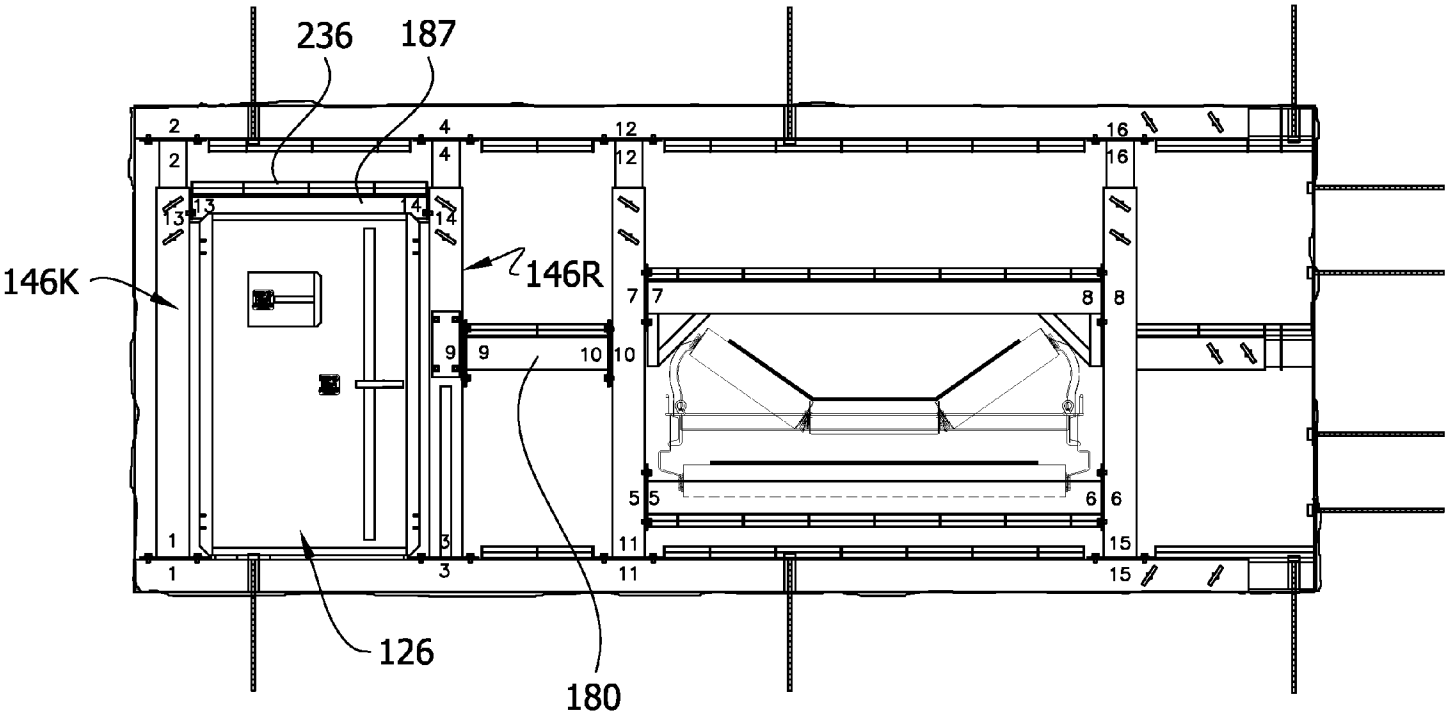
Figure 19:
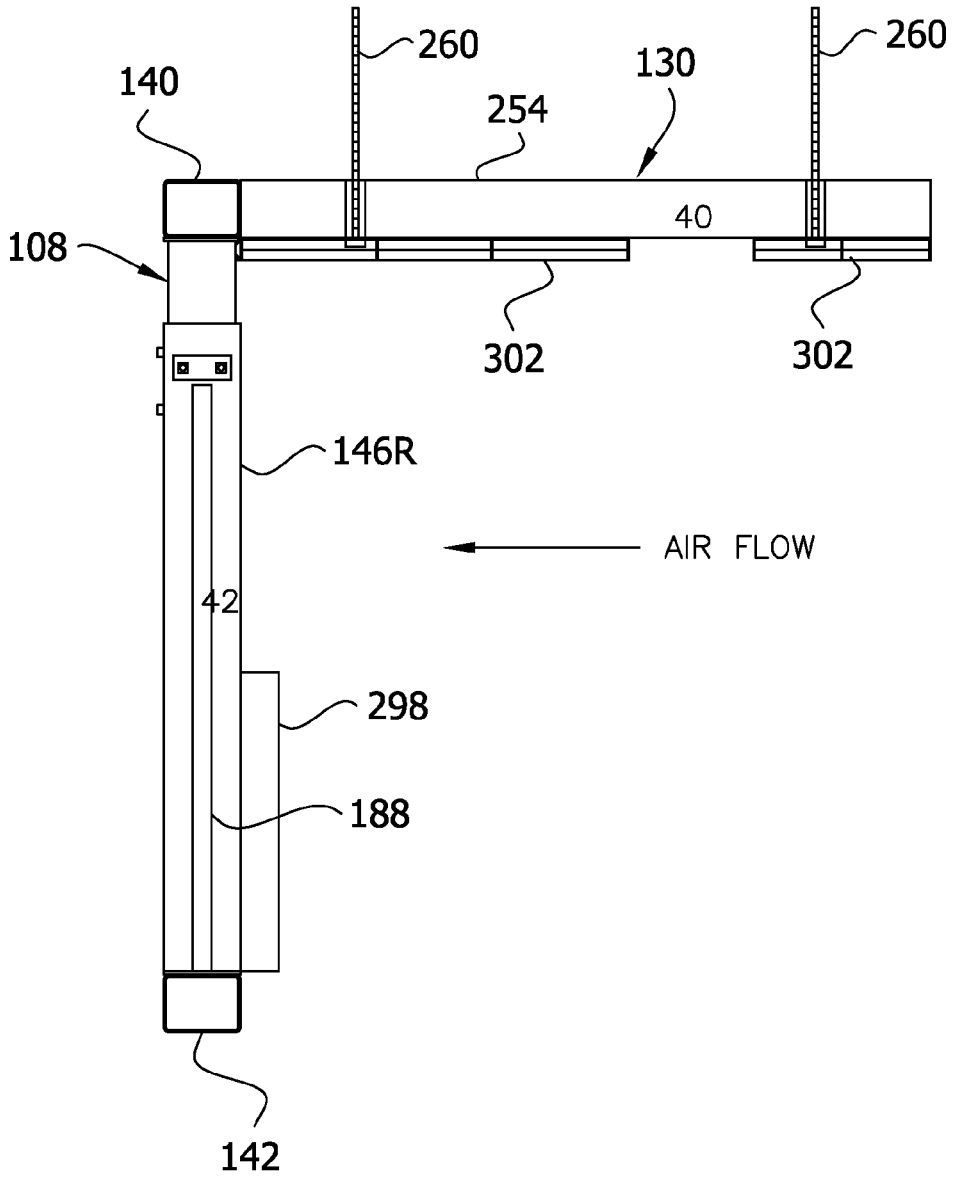

In step 2 (FIGS. 9 and 9A, FIG. 9A being a right end view of the roof and floor beams 140, 142 of FIG. 9), the floor beam 142 of the outby wall 108 is installed using anchor bolts 152. The open sides of the angle bars 236 should face the high-pressure air flow. The vertical centerline 310 of the belt conveyor 106 should be vertically aligned with a centerline mark 316 on the floor beam 142 to insure that there is adequate belt-to-frame clearance in later steps. The floor beam 142 has bolt patterns indicated at 1, 3, 11, and 15 spaced at horizontal intervals along its length.

In step 3 (FIG. 10), vertical beam 146J having bolt-hole patterns indicated at 15, 6, 8, and 16 spaced at vertical intervals along its length is installed at the position shown by bolting the end plate 154 at the lower end of the beam to the floor beam 142 using bolts 158 (e.g., four ⅝" by 1¼ in. bolts), flat washers, and lock-washers. The T-handle set screws 160 are loosened, and the upper vertical beam member 146B is telescoped up to bring the upper end plate 154 into engagement with the roof beam 140. The end plate 154 is then bolted in place using bolts (e.g., four ⅝" by 1¼ in. bolts), flat washers, and lock-washers, and the T-handle set screws 160 of the vertical beam 146J are tightened.

Also in step 3, the T-handle set screws 174 of the horizontal side beam 164 attached to the vertical beam 146J are loosened and the inside horizontal member 164B of the beam is moved to bring the end plate assembly 168 on the member into engagement with the adjacent rib 102S of the mine passage. The end plate assembly 168 is anchored to the rib using anchor bolts 170, and the T-handle set screws 174 are tightened.

In step 4 (FIG. 11), vertical beam 146*i* having bolt-hole patterns indicated at 11, 5, 7, 12, and 10 spaced at vertical intervals along its length is installed at the position shown by bolting the end plate at the lower end of the beam to the floor beam 142 using bolts (e.g., four ⅝" by 1¼ in. bolts), flat washers, and lock-washers. The T-handle set screws 160 are loosened, and the upper vertical beam member 146B is telescoped up to bring the upper end plate into engagement with the roof beam 140. The end plate is then bolted in place using bolts (e.g., four ⅝" by 1¼ in. bolts), flat washers, and lock-washers, and the T-handle set screws of the vertical beam are tightened.

In step 5 (FIG. 12), the upper horizontal frame member 190 of the conveyor belt aperture frame assembly 120 is installed at the position shown by bolting the end plates 196 of the frame member to the vertical beams 146*i*, 146J using bolts (e.g., eight ⅝" by 1¼ in. bolts), flat washers, and lock-washers. The angle bar 236 should be on the top side of the frame member 190, as shown. The horizontal frame member 190 has bolt-hole patterns indicated at 7 and 8 in its end plates 196 that match up with patterns 7 and 8 on the vertical beams 146*i*, 146J.

In step 6 (FIG. 13), the lower horizontal frame member 192 of the conveyor belt aperture frame assembly 120 is installed at the position shown by bolting the end plates 196 on the frame member to the vertical beams 146*i*, 146J using bolts (e.g., eight ⅝" by 1¼ in. bolts), flat washers, and lock-washers. The angle bar 236 should be on the bottom side of the frame member 192, as shown. The horizontal frame member 192 has bolt-hole patterns indicated at 5 and 6 in its end plates 196 that match up with patterns 5 and 6 on the vertical beams 146*i*, 146J.

In step 7 (FIG. 14), the vertical beam 146K having bolt-hole patterns 1, 2, and 13 spaced at vertical intervals along its length is installed at the position shown by bolting the end plate 154 at the lower end of the beam to the floor beam 142 using bolts (e.g., four ⅝" by 1¼ in. bolts), flat washers, and lock-washers. The T-handle set screws 160 are loosened, and the upper vertical beam member 146B is telescoped up to bring the upper end plate 154 into engagement with the roof beam 140. The end plate 154 is then bolted in place using, e.g., four ⅝" by 1¼ in. bolts), flat washers, and lock-washers, and the T-handle set screws 160 of the vertical beam are tightened.

In step 8 (FIG. 15), the access door 126 is mounted on the floor beam 142 with the tongue 188 on the floor beam and the tongue 188 on the vertical beam 146K received in respective grooves in the frame of the door, as shown. The door 126 is mounted to open against the high pressure air flow.

In step 9 (FIG. 16), the vertical beam 146R having bolt-hole patterns indicated at 3, 9, 14 and 4 spaced at vertical intervals along its length is installed at the position shown by bolting the end plate 154 at the lower end of the beam to the floor beam 142 using bolts (e.g., four ⅝" by 1¼ in. bolts), flat washers, and lock-washers. The tongue 188 on the vertical beam 146R is received in a groove in the frame of the door 126. The T-handle set screws 160 on the beam 146R are loosened, and the upper vertical beam member 146B is telescoped up to bring the upper end plate 154 into engagement with the roof beam 140. The end plate 154 is then bolted in place using bolts (e.g., four ⅝" by 1¼ in. bolts), flat washers, and lock-washers, and the T-handle set screws 160 of the vertical beam 146R are tightened.

In step 10 (FIG. 17), the horizontal lintel beam 187 having end plates 189 with bolt-hole patterns 13 and 14 is installed at the position shown above the door by bolting the end plates to the vertical beams 146R, 146K using bolts (e.g., eight ⅝" by 1¼ in. bolts), flat washers, and lock-washers. The tongue 188 on the lintel beam 187 is received in a groove in the frame of the door. The lintel beam 187 should be mounted so that the angle bar 236 is at the top side of the beam.

In step 11 (FIG. 18), the horizontal beam 180 having end plates 184 with bolt-hole patterns 9 and 10 is installed at the position shown by bolting the end plates to the vertical beams using bolts (e.g., eight ⅝" by 1¼ in. bolts), flat washers, and lock-washers. The angle bar 302 should be at the top side of the beam 180.

In step 12 (FIG. 19), the partition horizontal roof beam 254 with bolt-hole pattern 40 is installed at the position shown using anchor bolts 260. The open sides of the angle bars 302 on the beam should face the conveyor belt 106. The end of the roof beam 254 should butt up against the roof beam 142 of the outby wall frame 116.

Figure 20A:
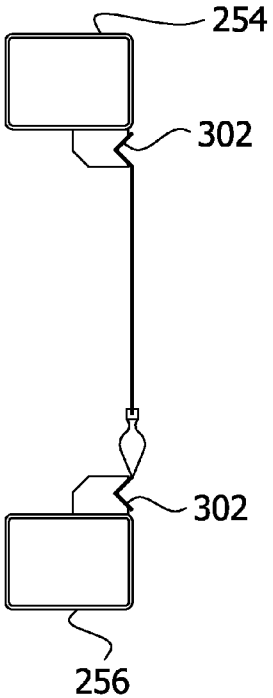
Figure 20:
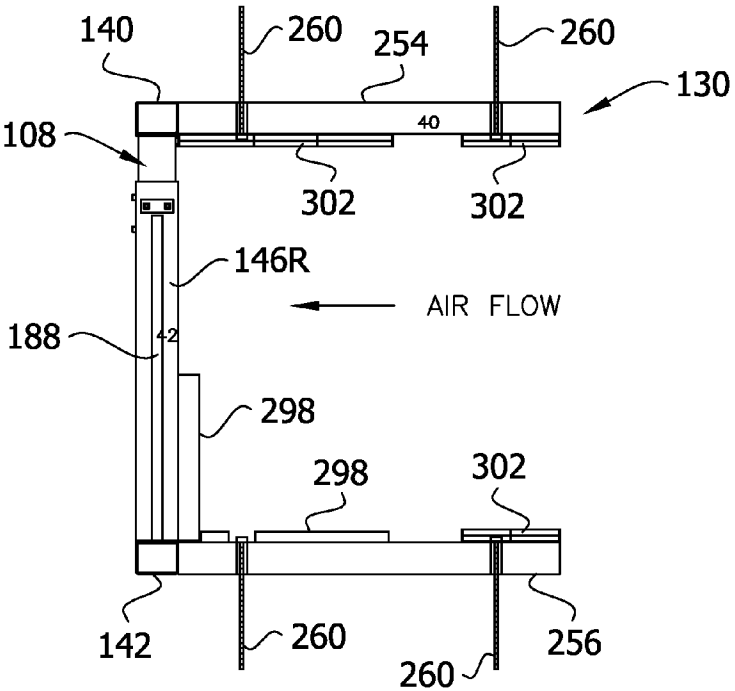
Figure 21:
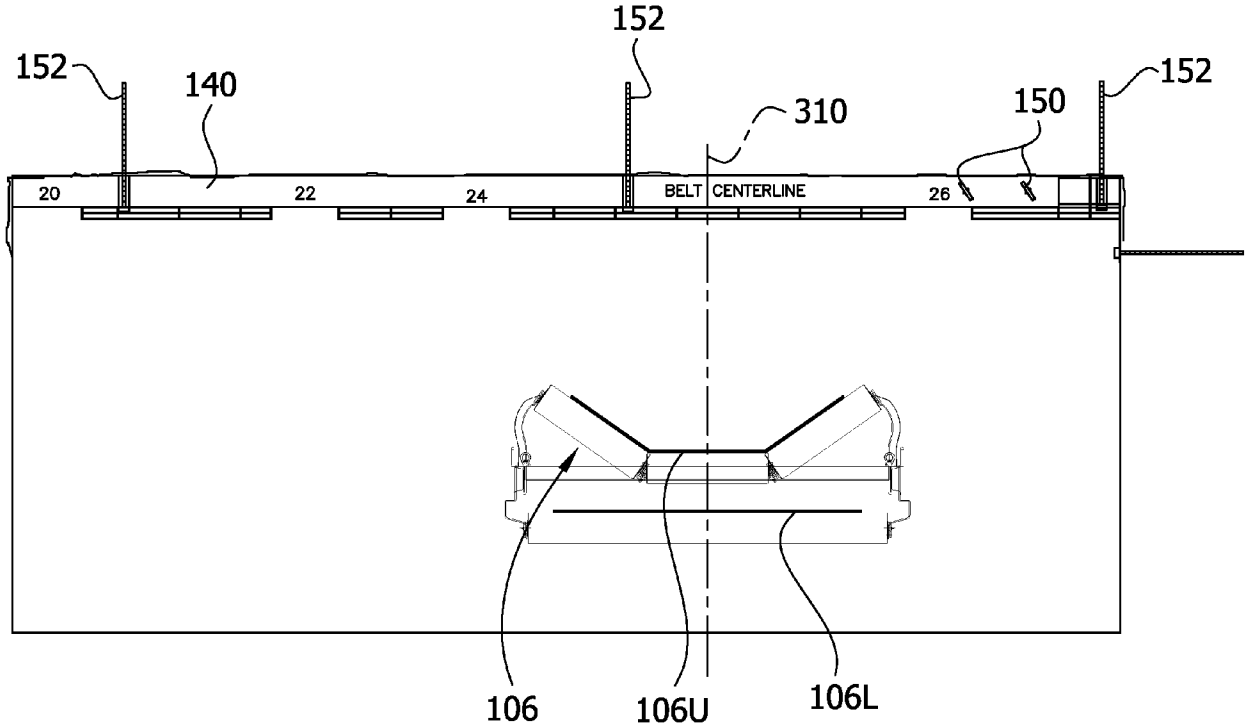
Figure 22A:
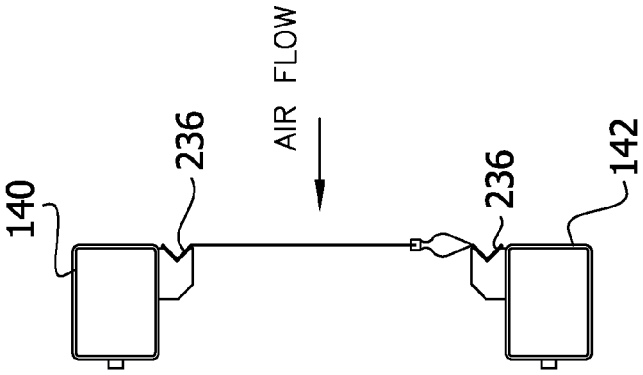
Figure 22:
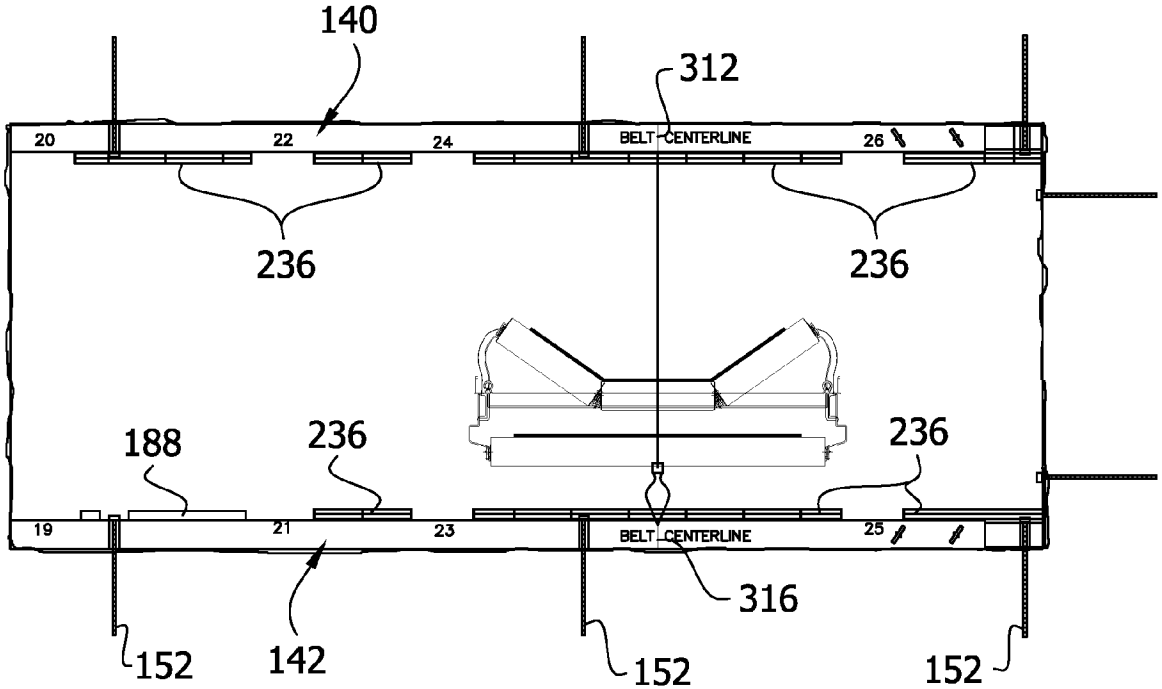
Figure 23:
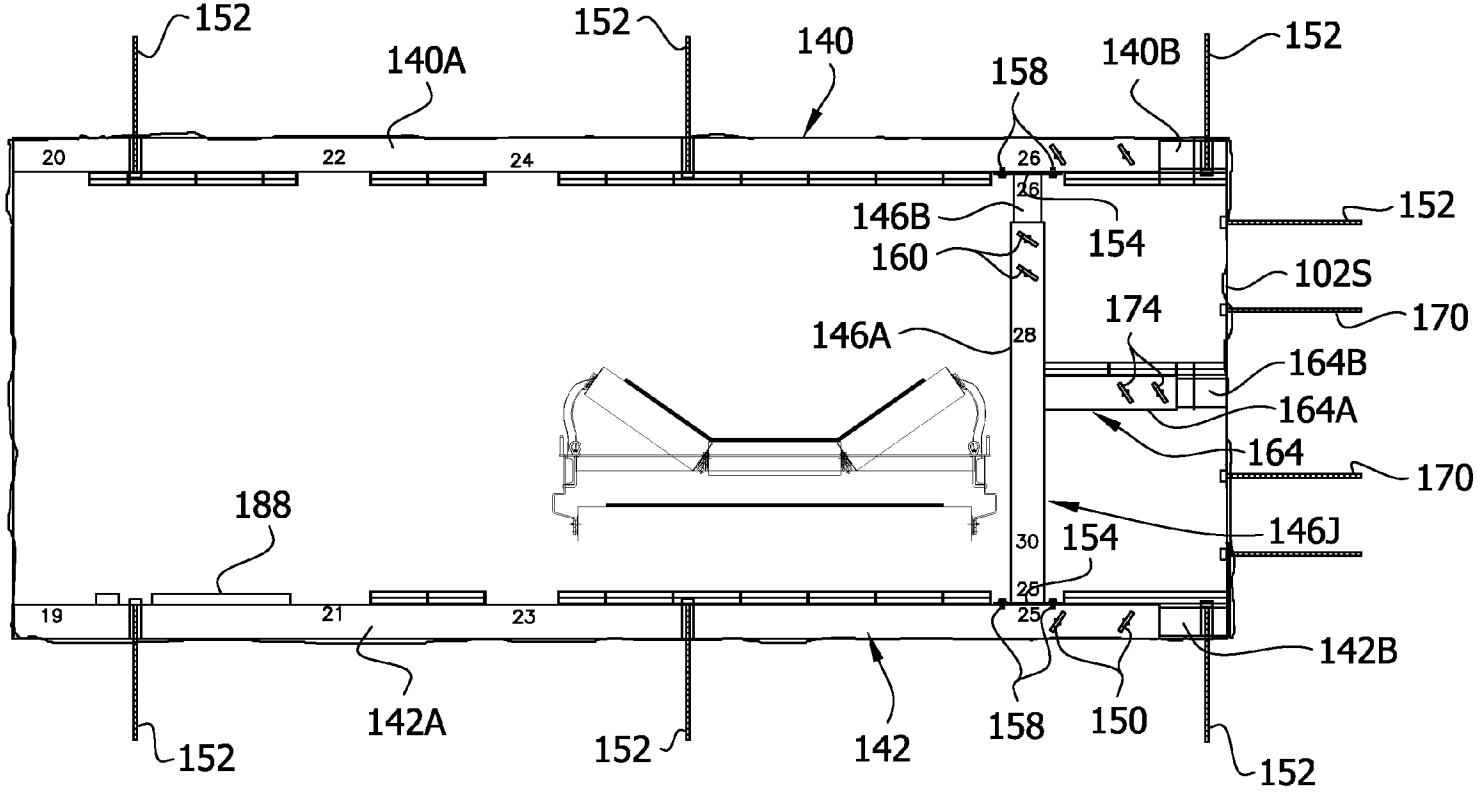
Figure 24:
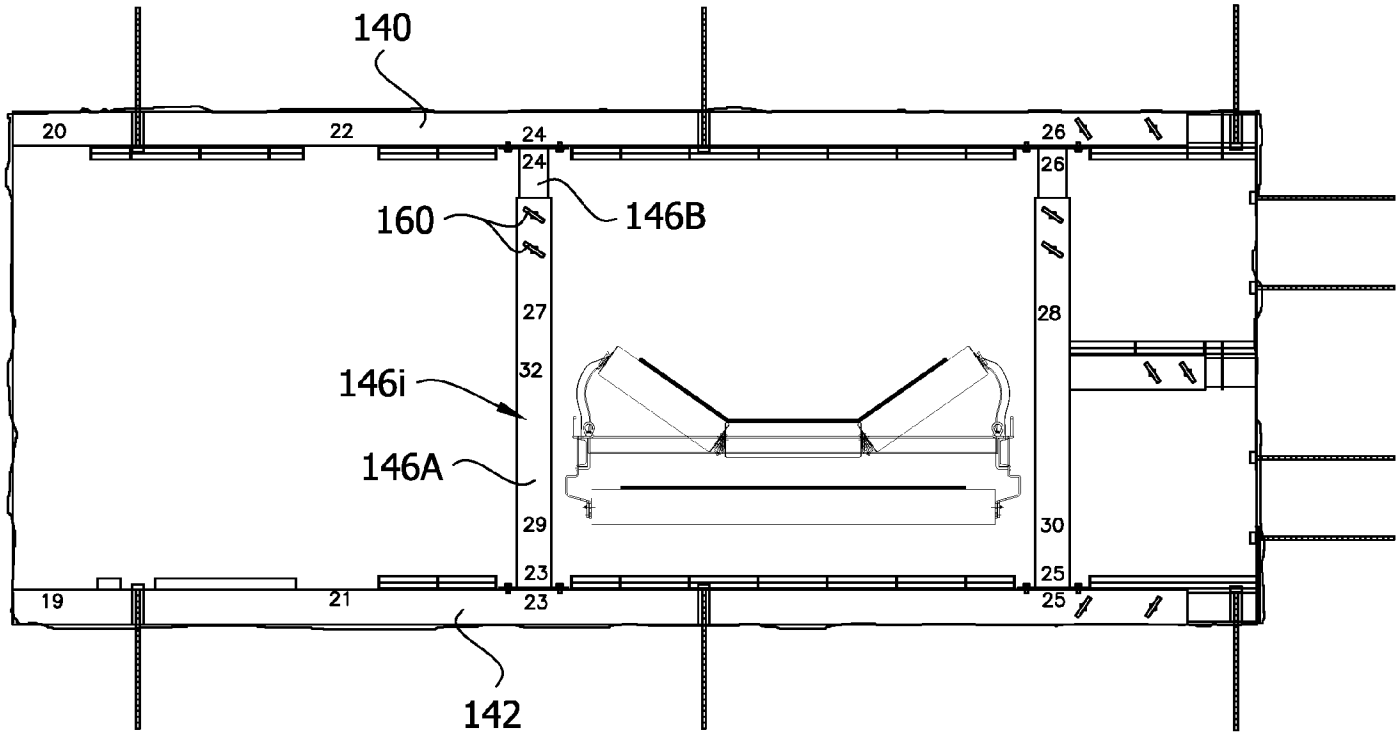
Figure 25:
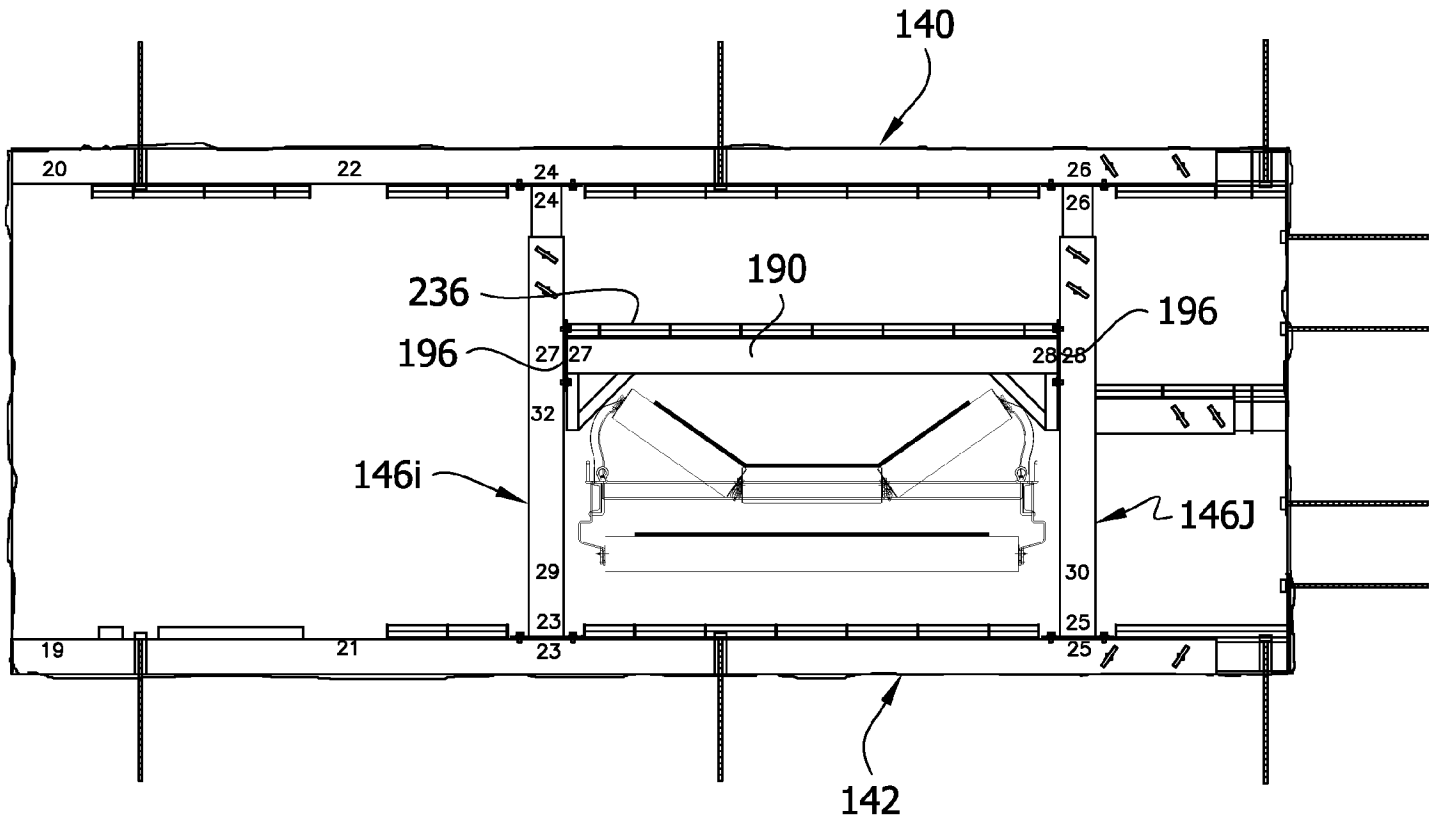
Figure 26:
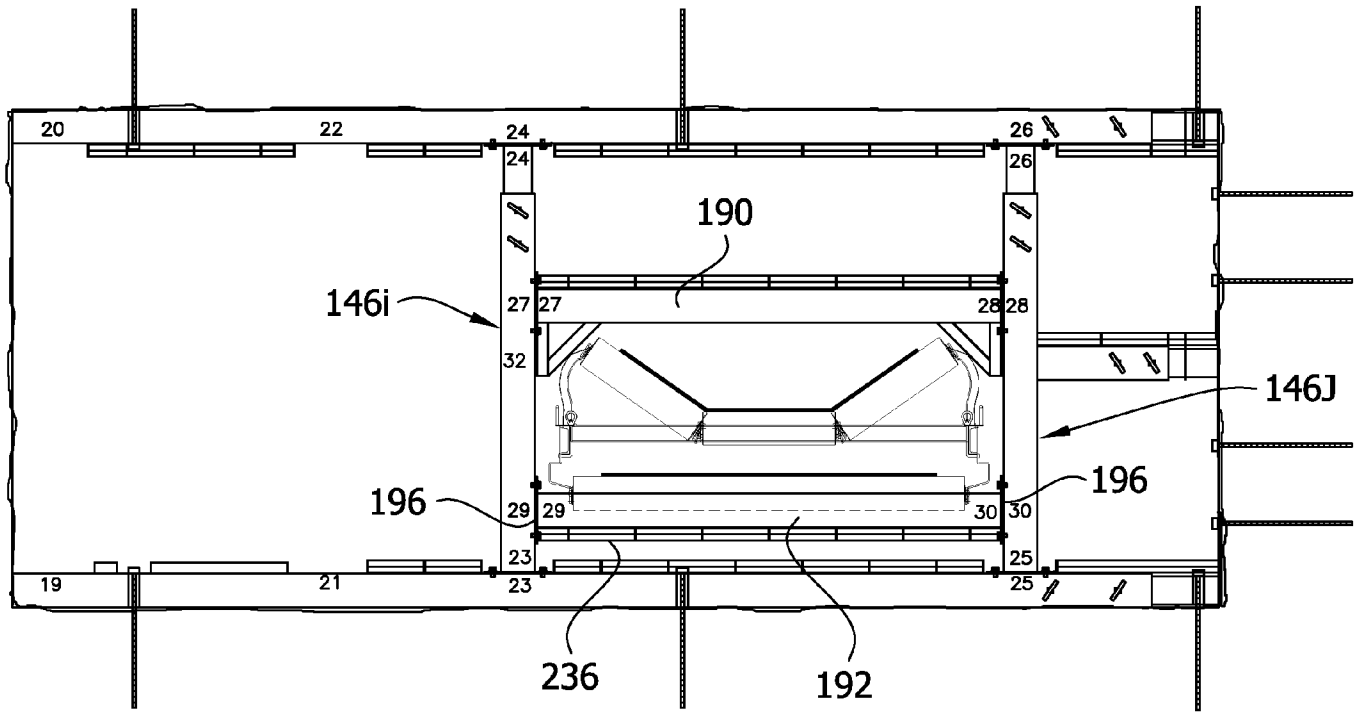
Figure 27:
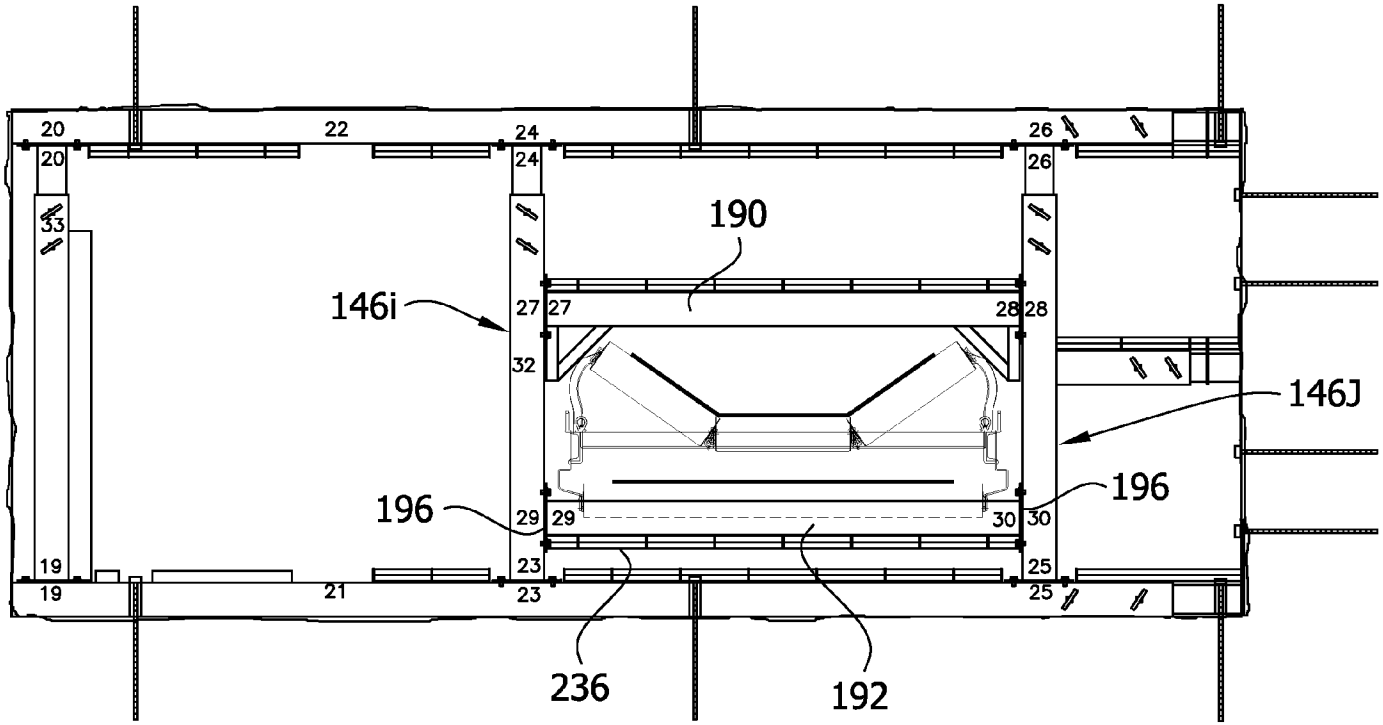
Figure 28:
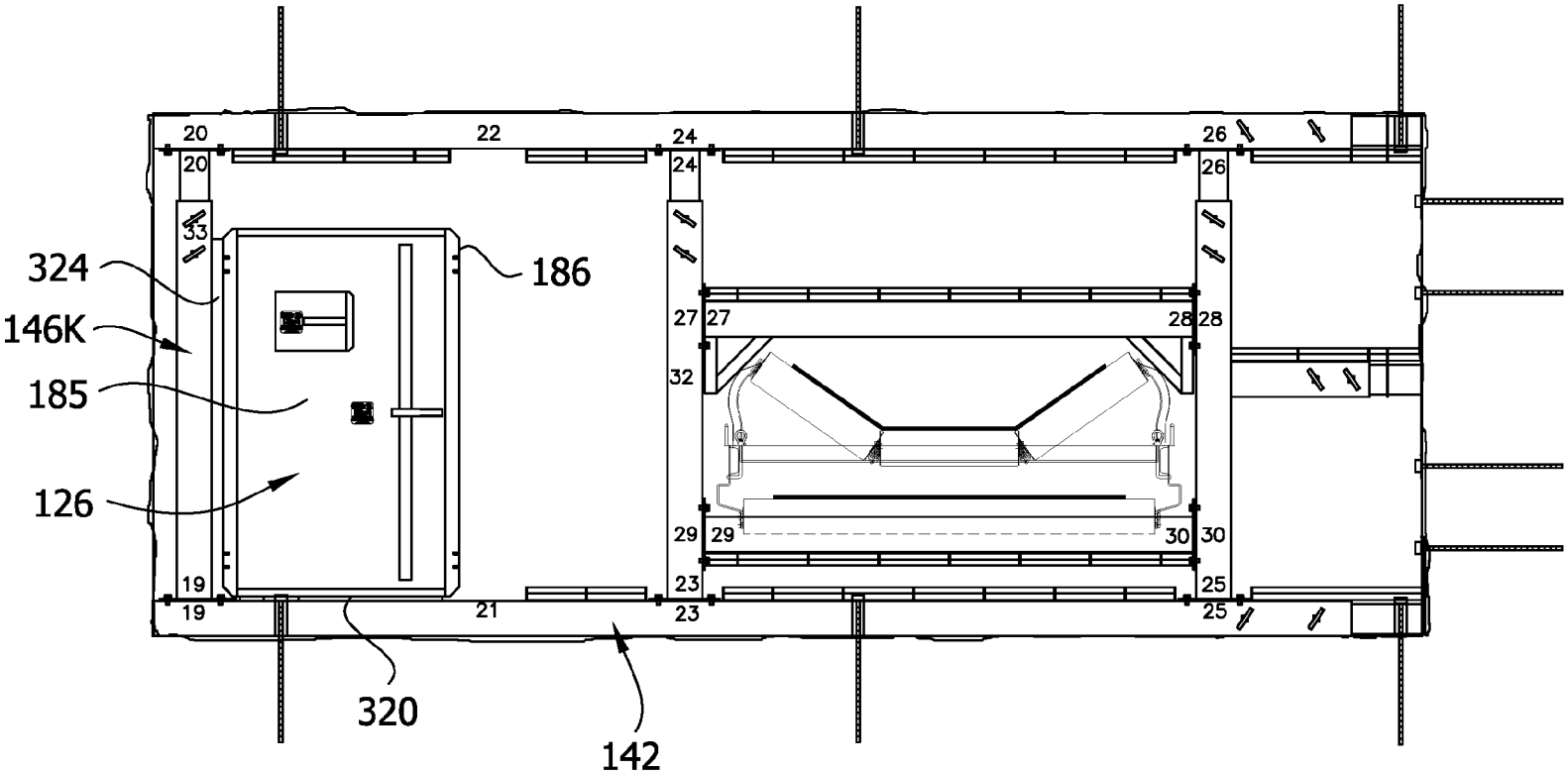
Figure 29:
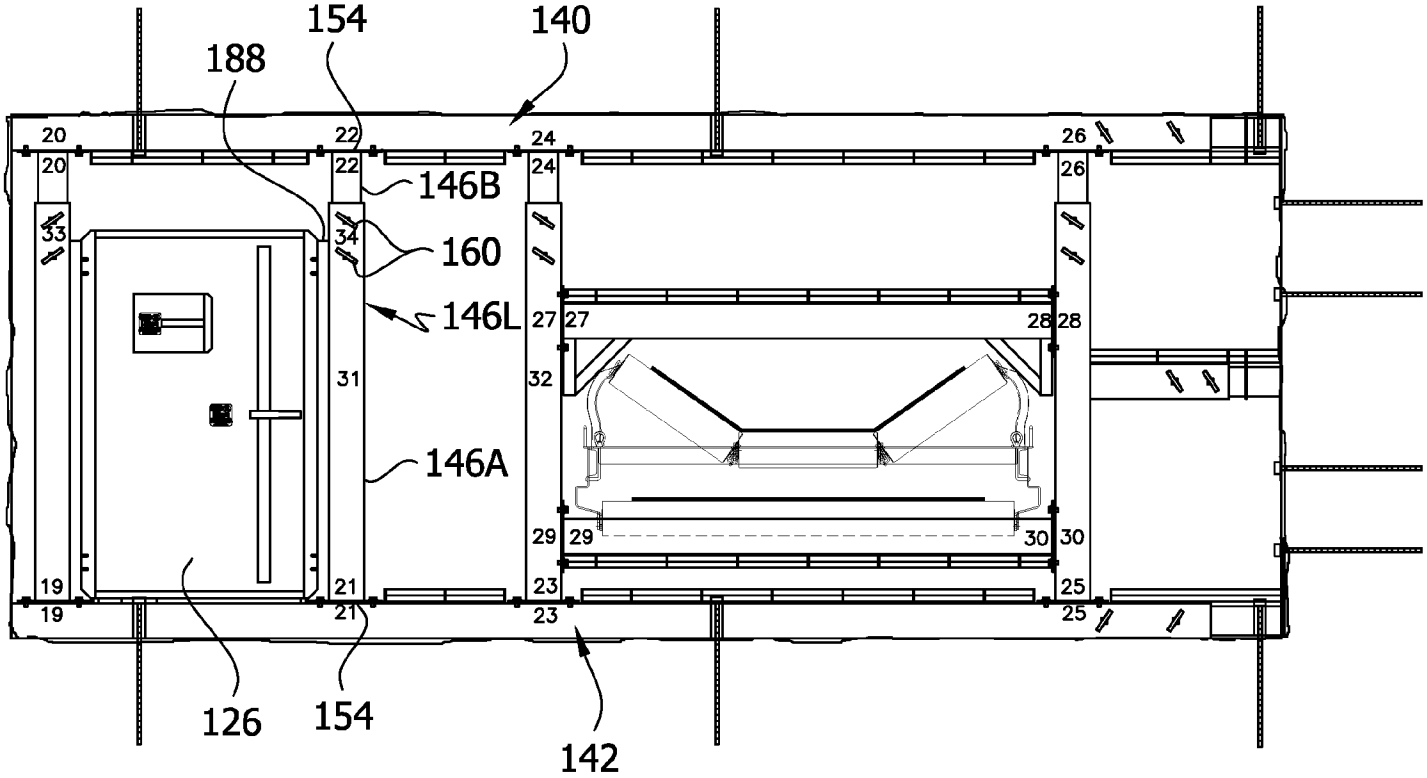
Figure 30:
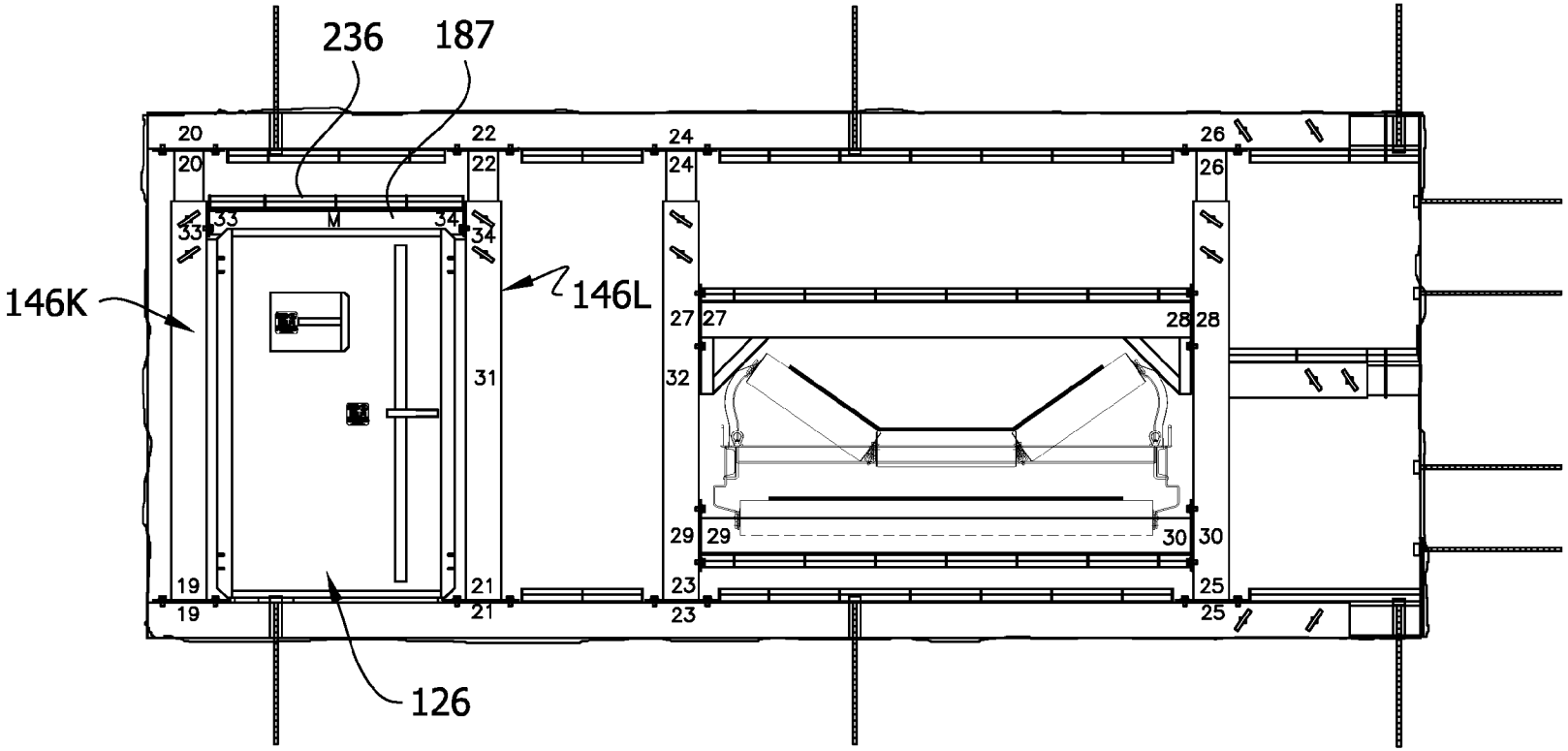
Figure 31:
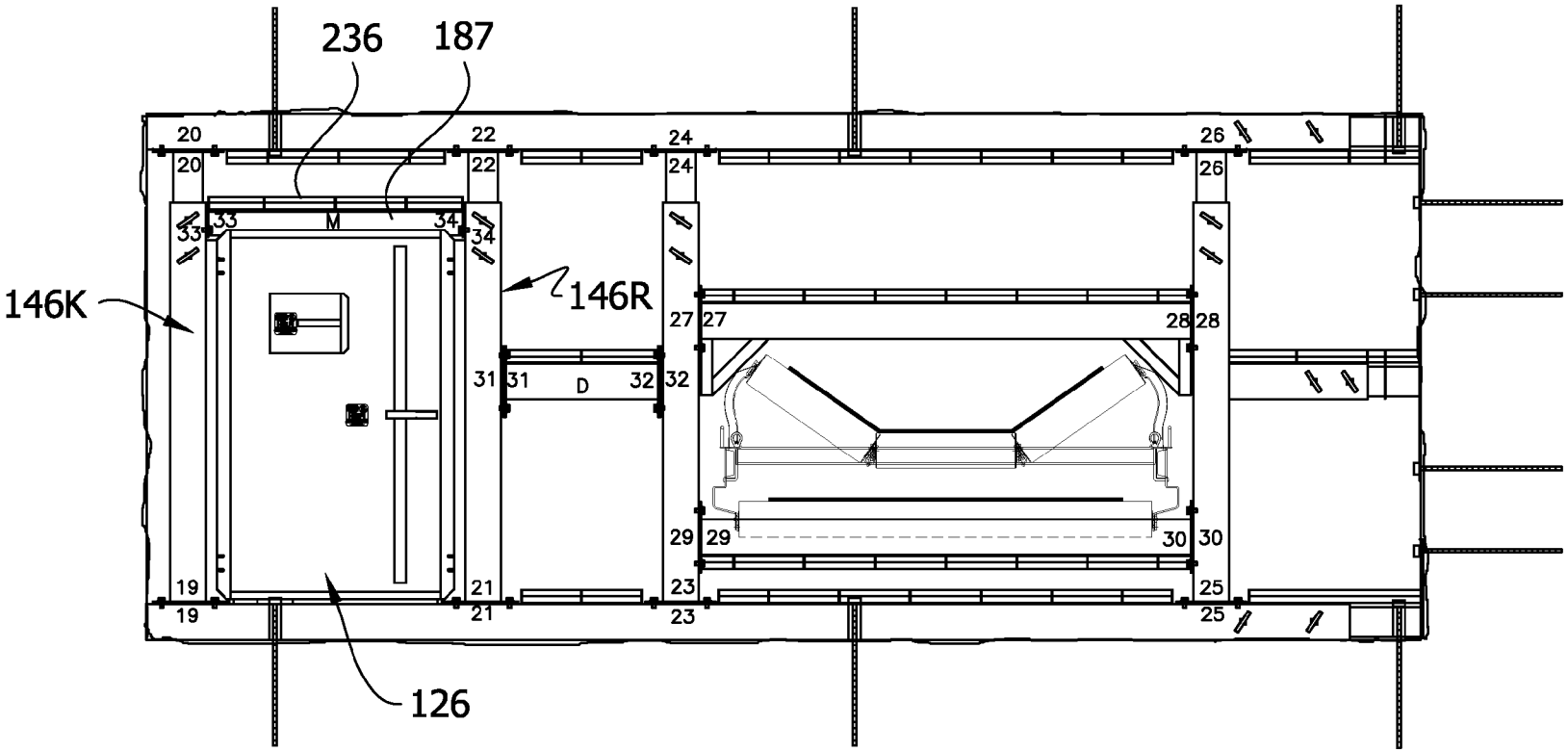
Figure 32:
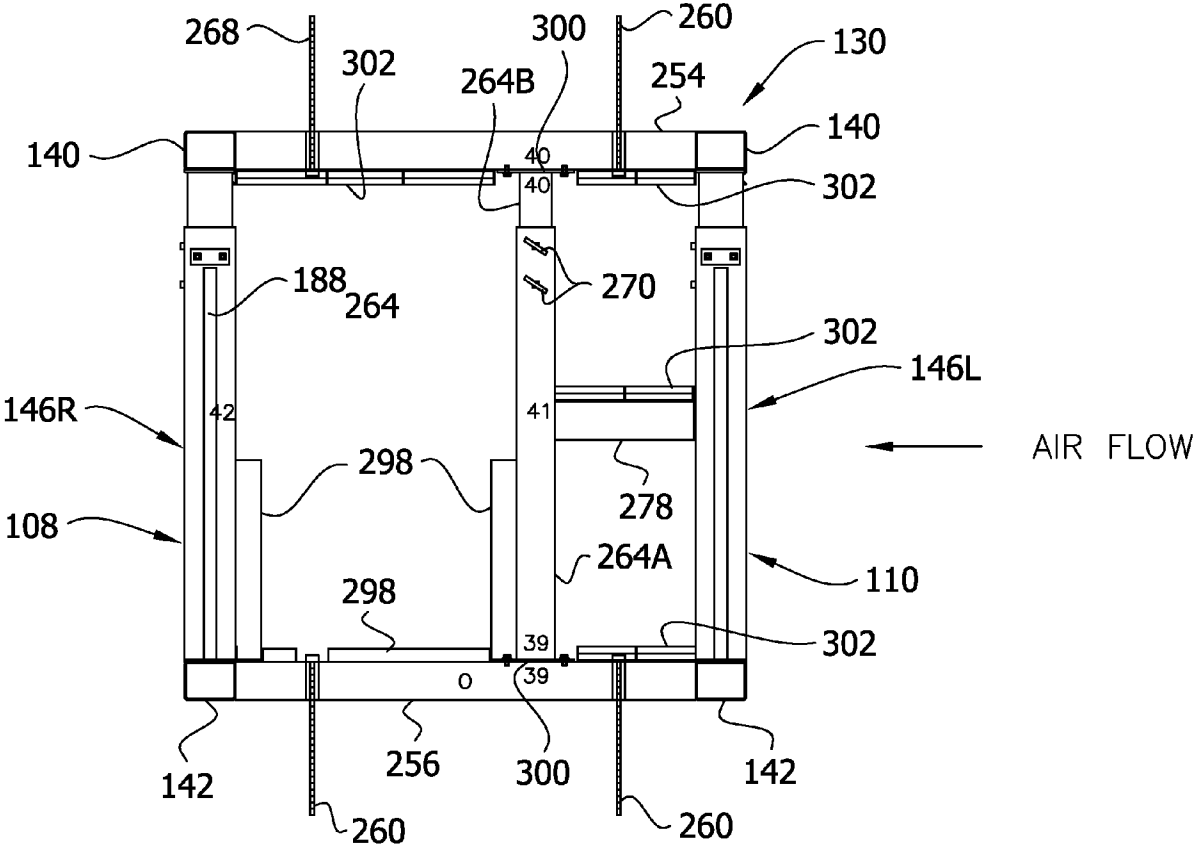
Figure 33:
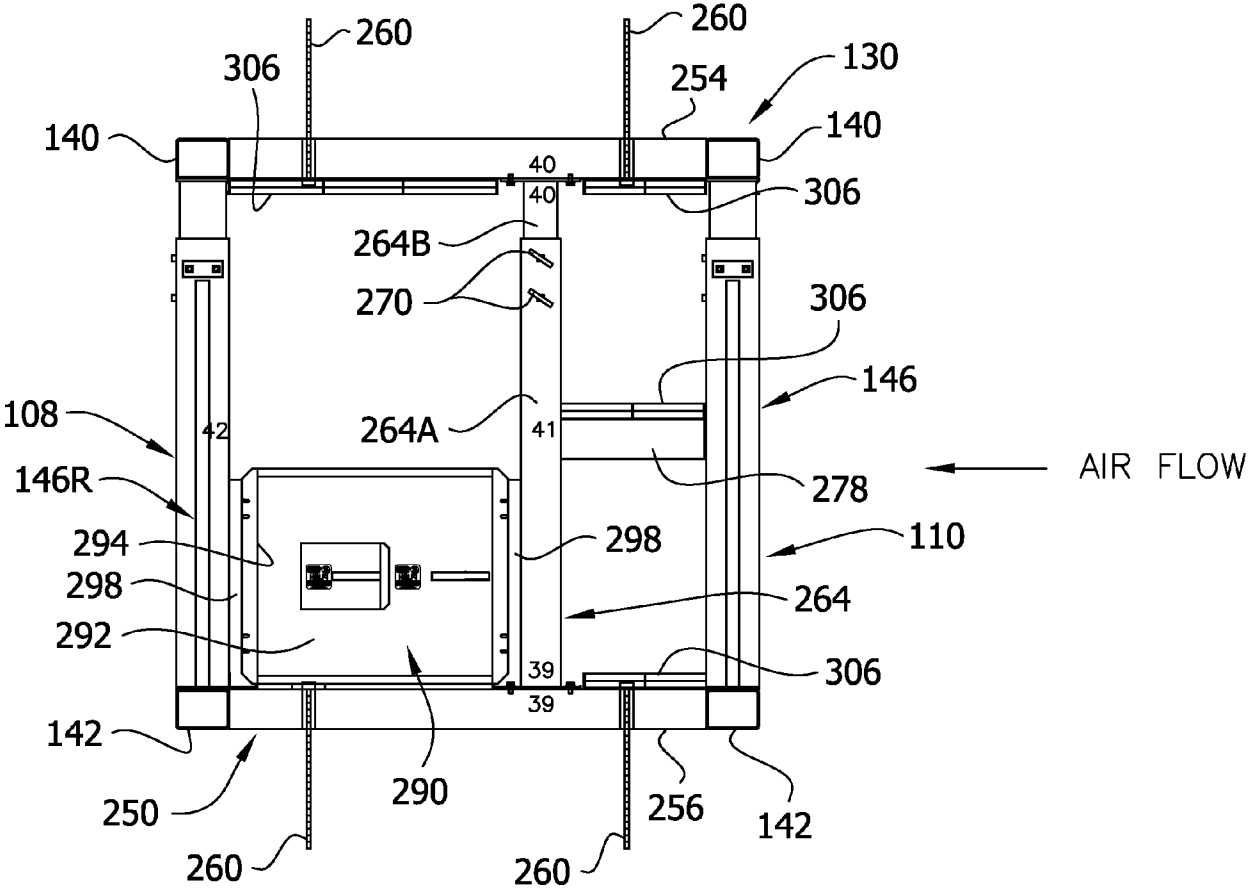
Figure 34:
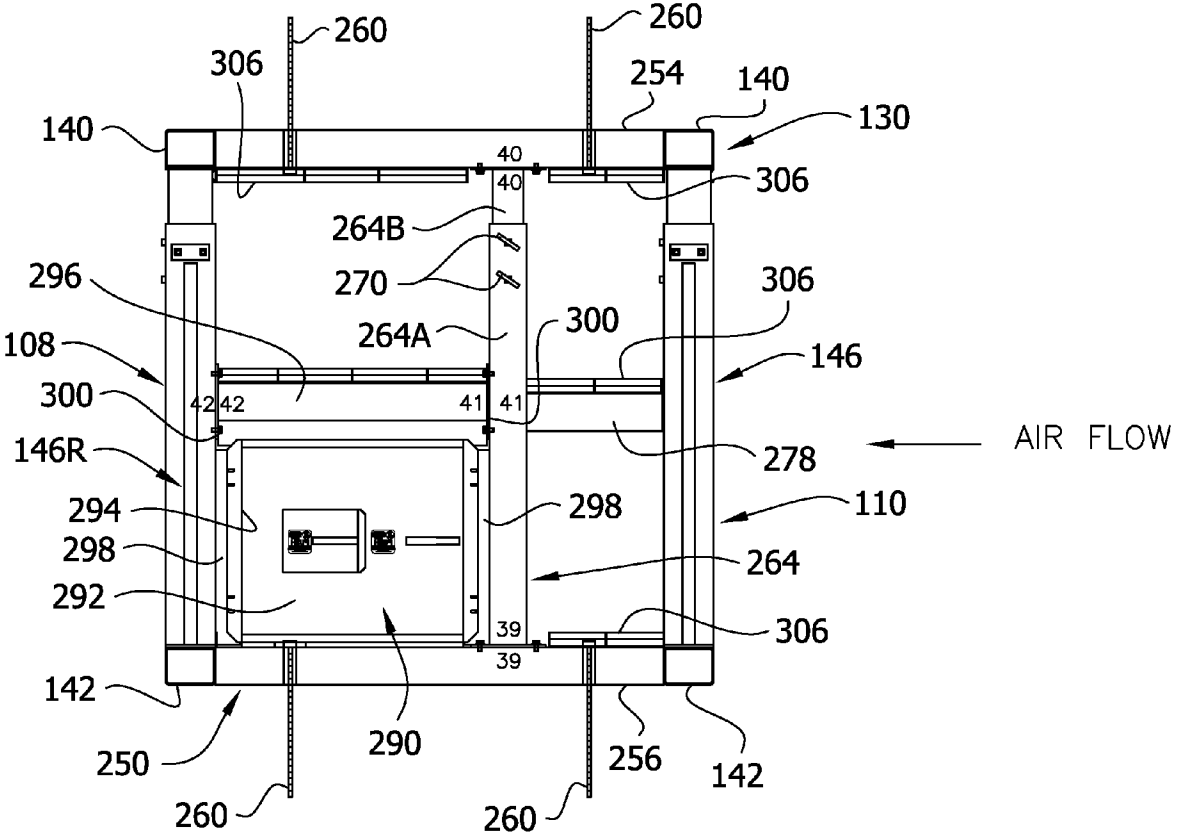

In step 13 (FIGS. 20 and 20A, FIG. 20A being a right end view of the partition roof and floor beams 254, 256 of FIG. 20), the partition horizontal floor beam 256 having bolt-hole pattern 39 is installed at the position shown using anchor bolts 260. The open sides of the angle bars 302 should face the conveyor belt 106. The end of the floor beam 256 should butt up against the floor beam 142 of the outby wall frame 116.

After completion of step 13, the inby wall 110 is installed using steps 14-24 illustrated in FIGS. 21-31. Steps 14-24 are essentially identical to steps 1-11 described above for installing the outby wall 108. The only difference is that in the inby wall 110, the vertical beam 146R (FIG. 16) is replaced by a vertical beam 146L (FIG. 29) having no tongue 298.

In step 25 (FIG. 32), the vertical partition beam 264 having bolt-hole patterns 39, 41, and 40 spaced at vertical intervals along its length is installed at the position shown by bolting the end plate 272 at the lower end of the beam to the floor beam using bolts 276 (e.g., four ⅝" by 1¼ in. bolts), flat washers, and lock-washers. The T-handle set screws 270 are loosened, and the upper vertical beam member 264B is telescoped up to bring the upper end plate 272 into engagement with the partition roof beam 254. The end plate 272 is then bolted in place using, e.g., four ⅝" by 1¼ in. bolts), flat washers, and lock-washers, and the T-handle set screws 270 of the vertical beam are tightened.

In step 26 (FIG. 33), the partition access door 290 is mounted on the partition floor beam 256 between the vertical beams 146R and 264, with the tongues 298 on the floor beam and the vertical beams received in respective grooves in the frame 294 of the door. The door 290 is mounted to open toward the conveyor belt 106.

In step 27 (FIG. 34), the lintel beam 296 having bolt-hole patterns 13 and 14 is installed over the access door 290 at the position shown by bolting the end plates 300 of the beam to adjacent vertical beams 146R, 264 using bolts (e.g., eight ⅝" by 1¼ in. bolts), flat washers, and lock-washers. The tongue 298 on the lintel beam 296 is received in a groove in the frame 294 of the door 290. The lintel beam 296 is mounted with its angle bar 306 at the top side of the beam.

Figure 35:
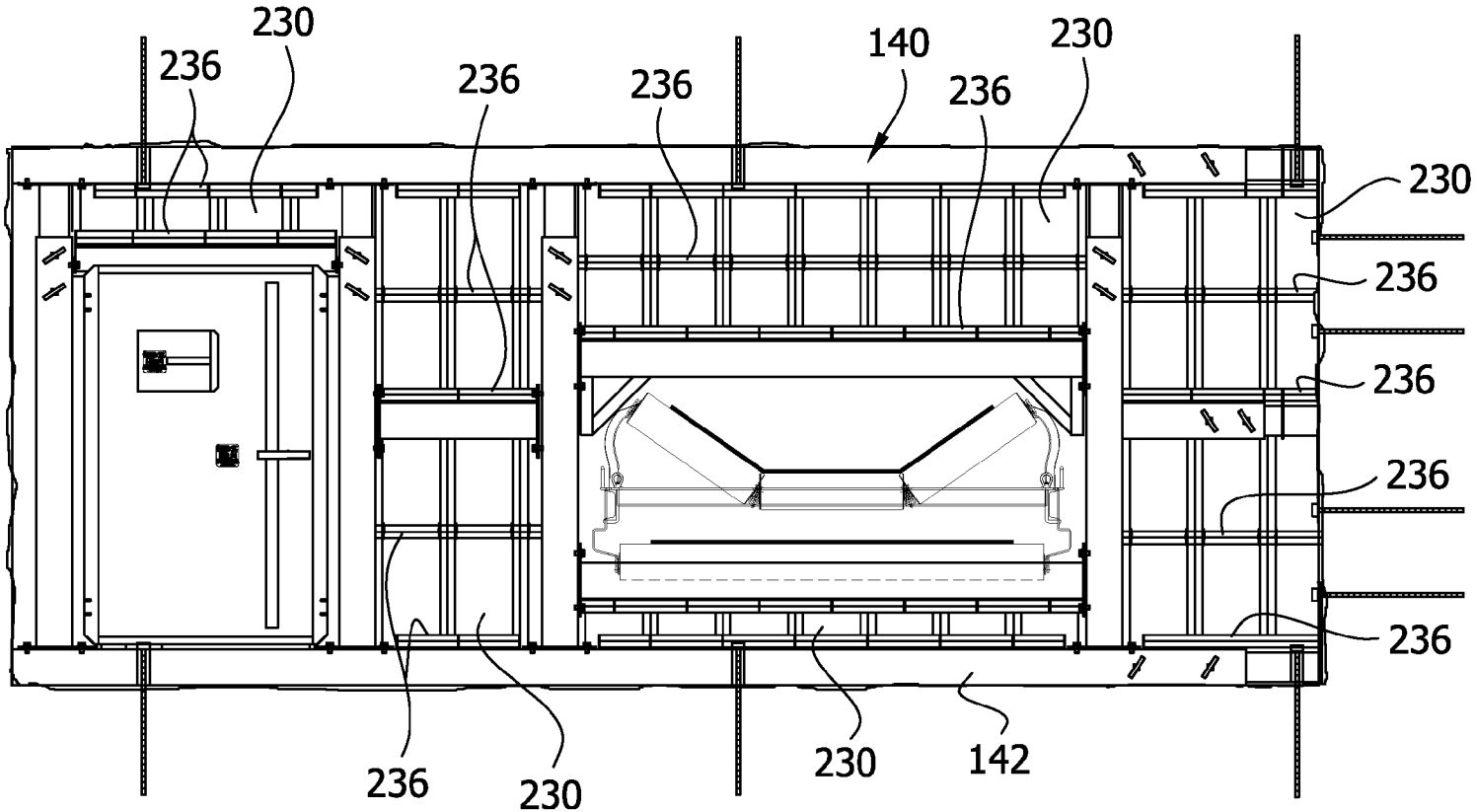

In step 28 (FIG. 35), stopping panels 230, 304 are installed on the angle bars 236 of the outby wall 108, the inby wall 110, and the belt side of the partition 130. (FIG. 35 shows only the outby wall.) Also, a suitable seal (e.g., rubber belt) is installed around the belt area and attached to the aperture frame assembly 120 on each of the inby and outby walls 108, 110. Finally, the entire structure is suitably sealed, as by spraying it with a polyurethane spray foam sealant to close all seams between the stopping panels 230, 304 and beams.

Figure 36:
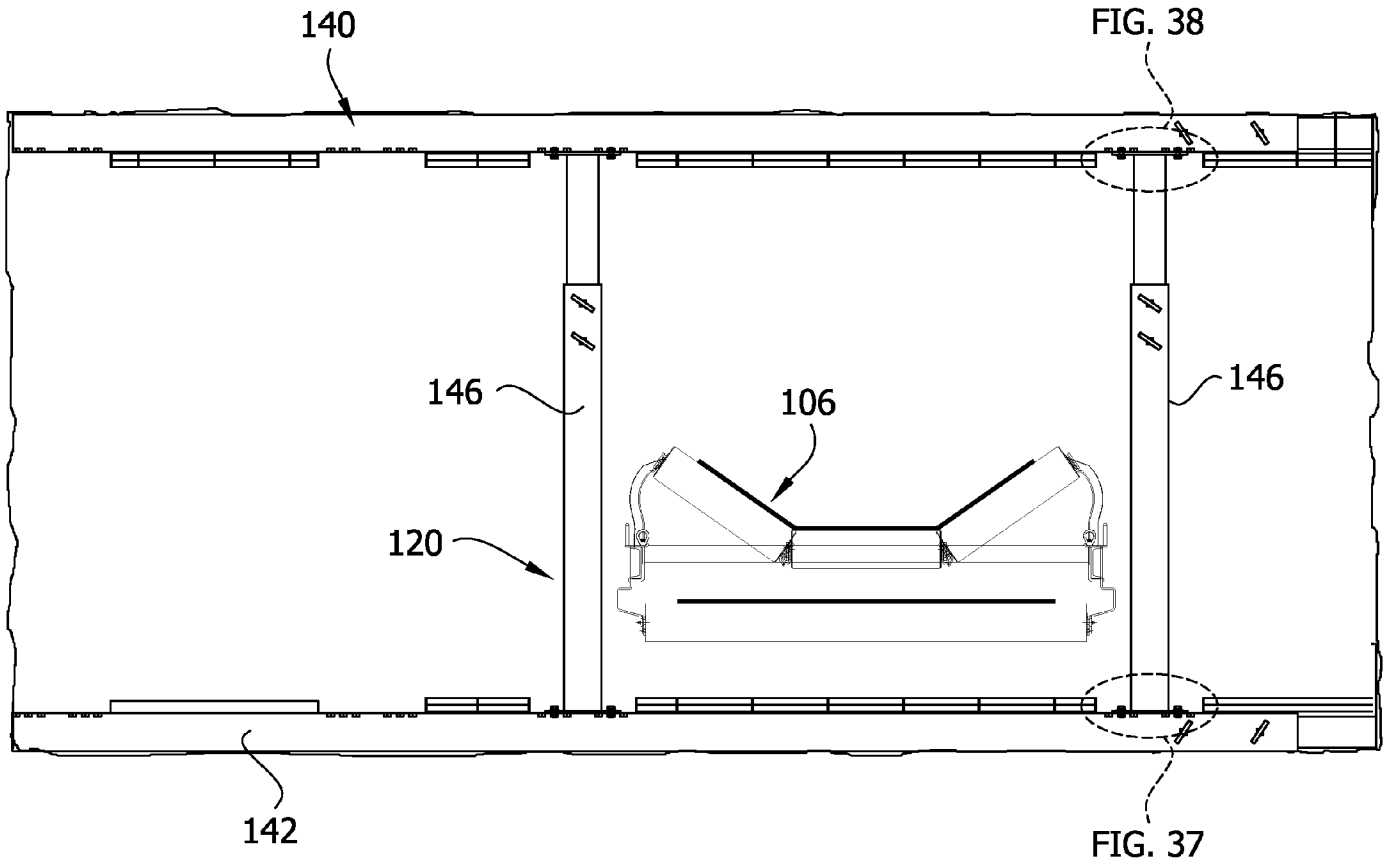
FIG. 36 is a front elevation of portions of a wall frame of the box check in which the vertical beams of the conveyor belt aperture frame assembly can be attached to the roof and floor beams at selected horizontal locations to allow for custom fitting of the frame assembly around a conveyor belt.
Figure 37:
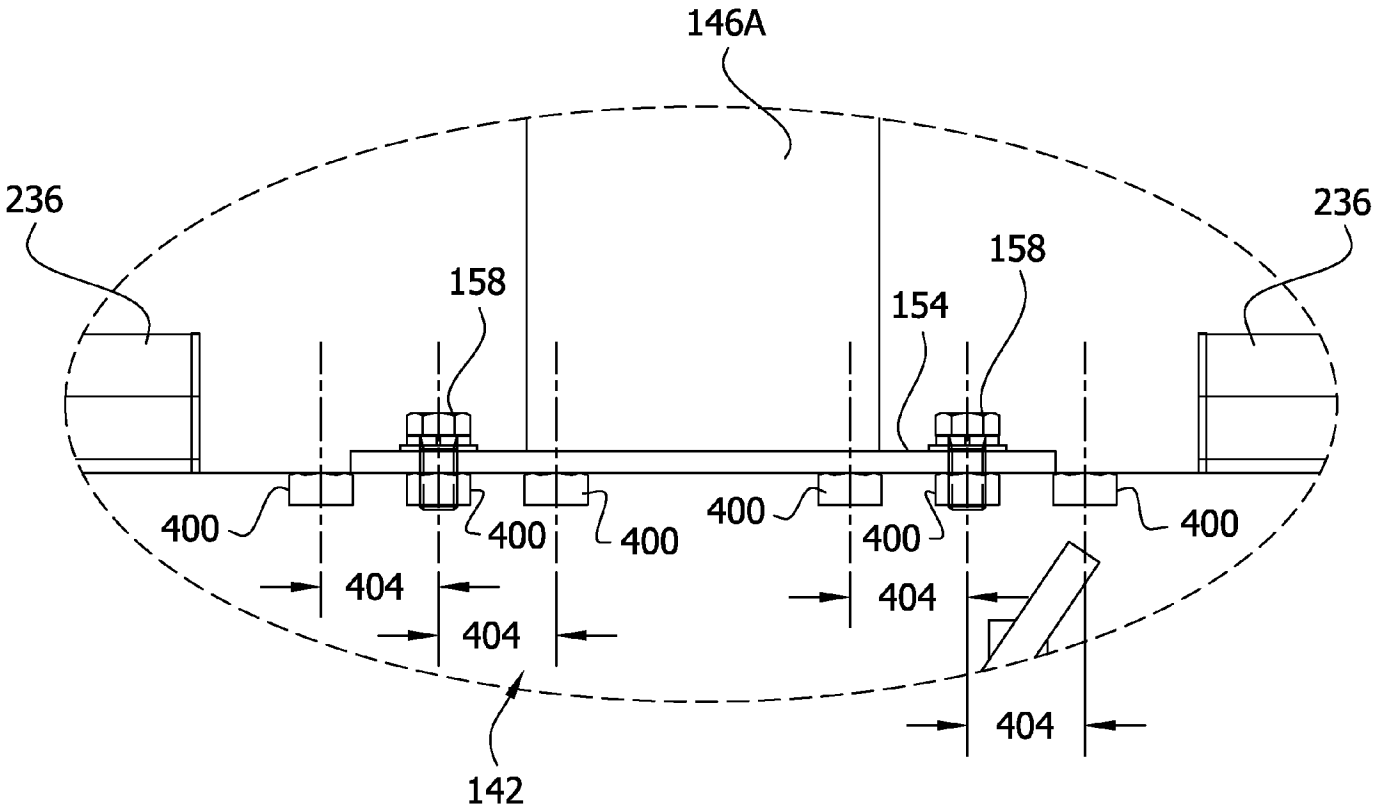
FIG. 37 is an enlarged portion of FIG. 36 showing multiple bolt-hole patterns spaced at intervals along the floor beam to allow a vertical beam of the conveyor belt aperture frame assembly to be selectively attached at one of several different horizontal locations along the floor beam.
Figure 38:
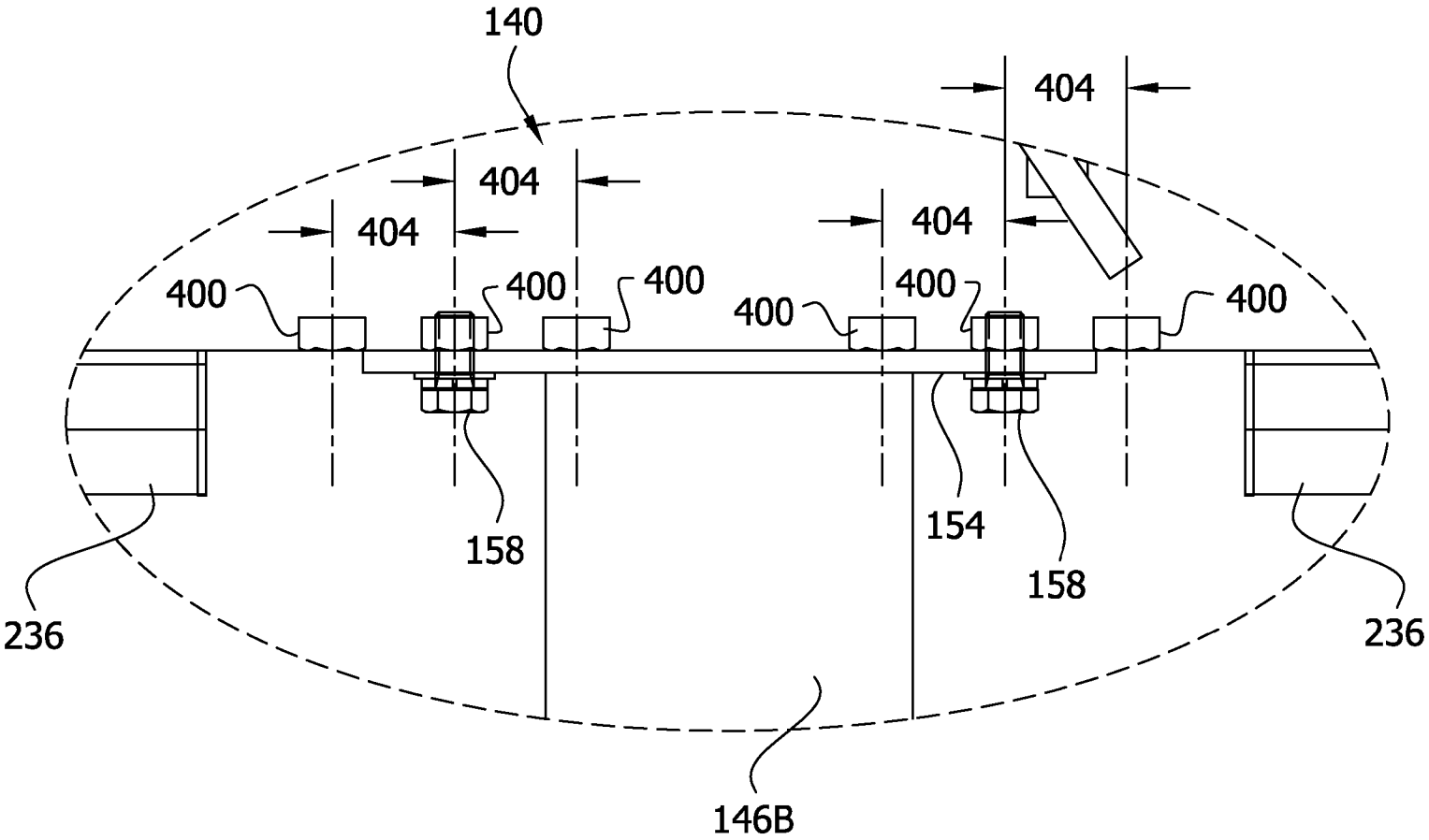
FIG. 38 is an enlarged portion of FIG. 36 showing multiple bolt-hole patterns spaced at intervals along the roof beam to allow a vertical beam of the conveyor belt aperture frame assembly to be selectively attached at one of several different horizontal locations along the roof beam.
Figure 39:
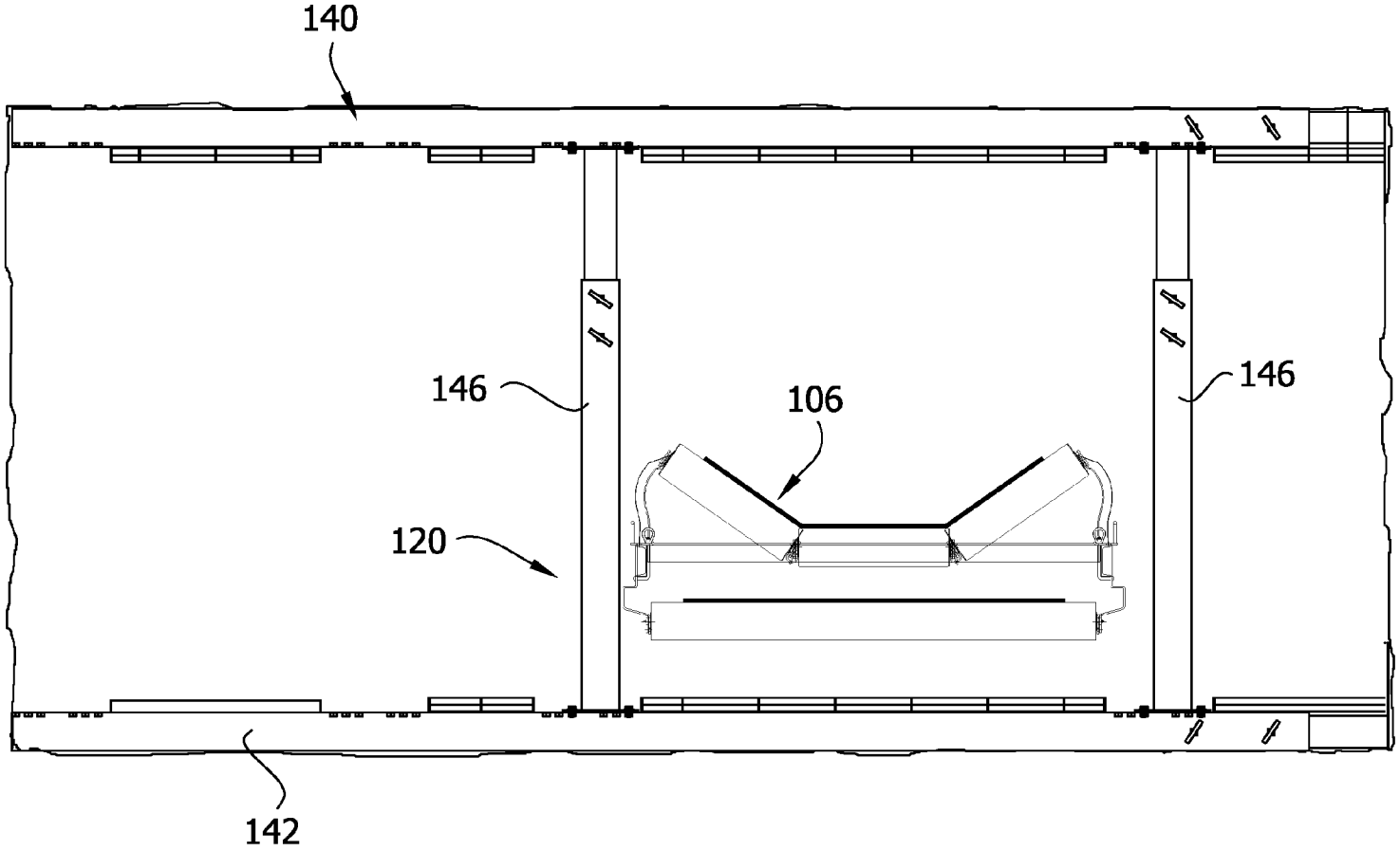
FIG. 39 is a view similar to FIG. 36 but showing the vertical beams installed at alternative horizontal locations.
Figure 40:
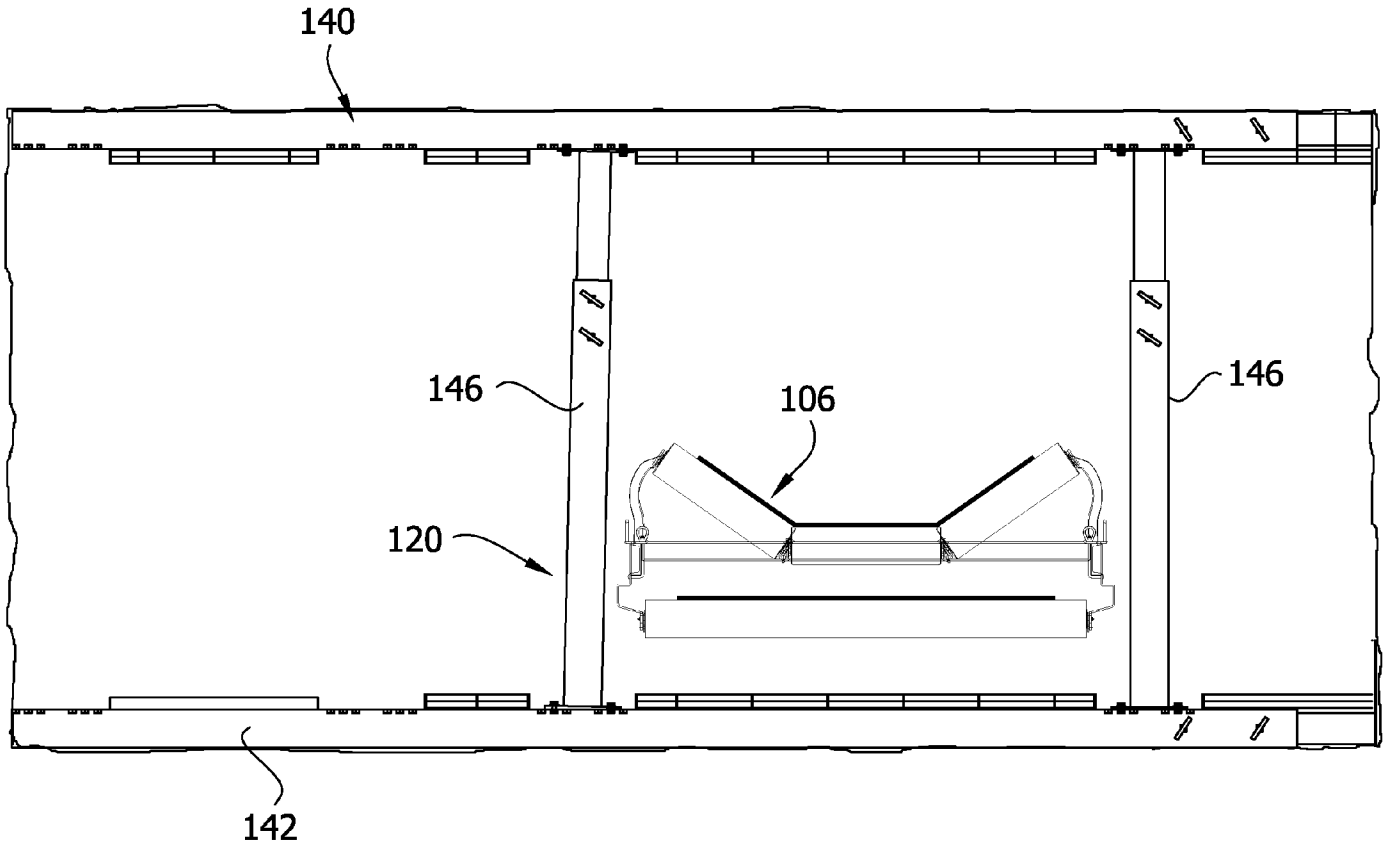
FIG. 40 is a view similar to FIGS. 36 and 39 but showing the vertical beams installed at different alternative horizontal locations.

Referring to FIGS. 36-38, the vertical beams 146 forming opposite sides of the conveyor belt aperture frame assembly 120 can be bolted to the roof and floor beams 140, 142 at different locations along the horizontal beams to allow for custom fitting of the frame assembly around a conveyor belt 106, which is typically installed before the box check 100 is installed. To facilitate assembly, the roof and floor beams 140, 146 have patterns of pre-drilled bolt holes 400. The bolt-hole patterns are spaced at intervals 404 along the beams. By way of example only, each of the vertical beams 146 of the frame assembly 120 can be bolted to the roof and floor beams 140, 142 at three different locations spaced at horizontal intervals 404 (e.g., two-inch intervals) along the beam. The three different locations are illustrated in FIGS. 36, 39, and 40. The roof and floor beams 140, 142 can have more or fewer horizontally-spaced bolt-hole locations to provide more or less adjustment of the frame assembly 120.

Figure 41:
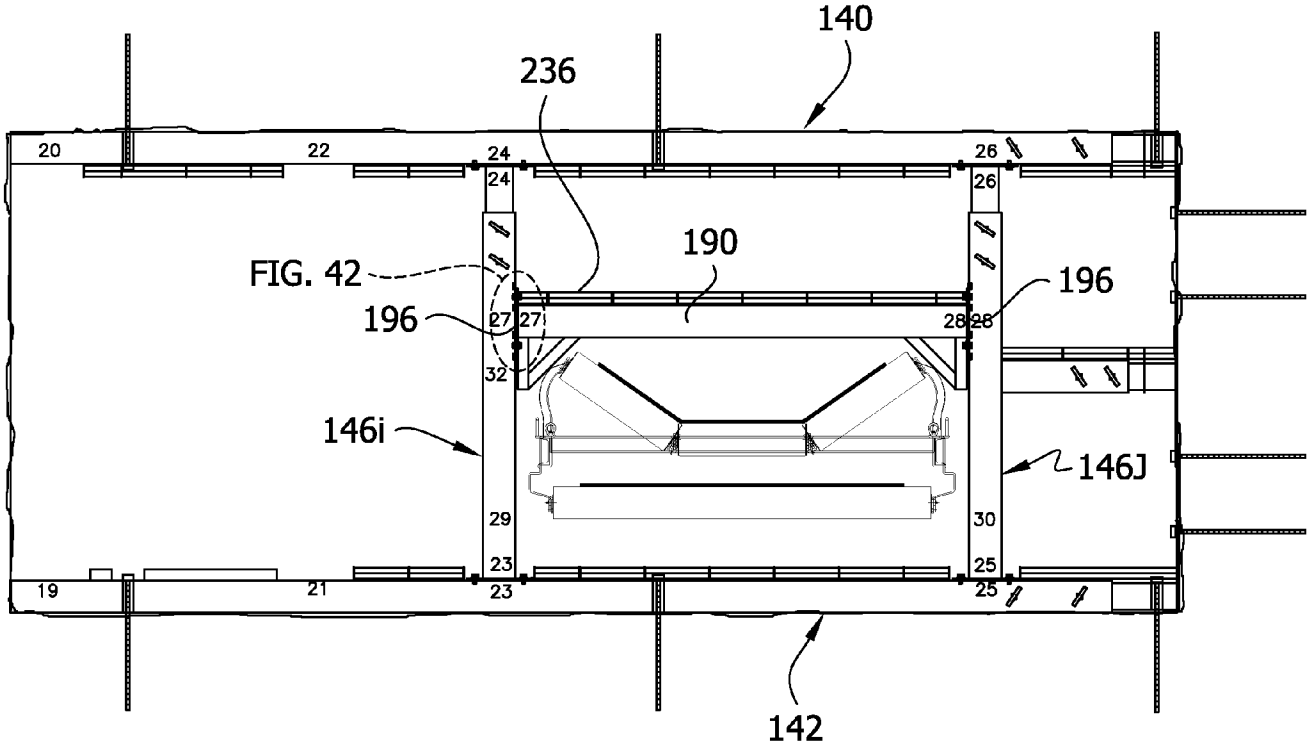
FIG. 41 is a front elevation of portions of a wall frame of the box check in which an upper horizontal frame member of the conveyor belt aperture frame assembly can be attached to vertical beams of the assembly at different vertical locations to allow for custom fitting of the frame assembly around a conveyor belt.
Figure 42:
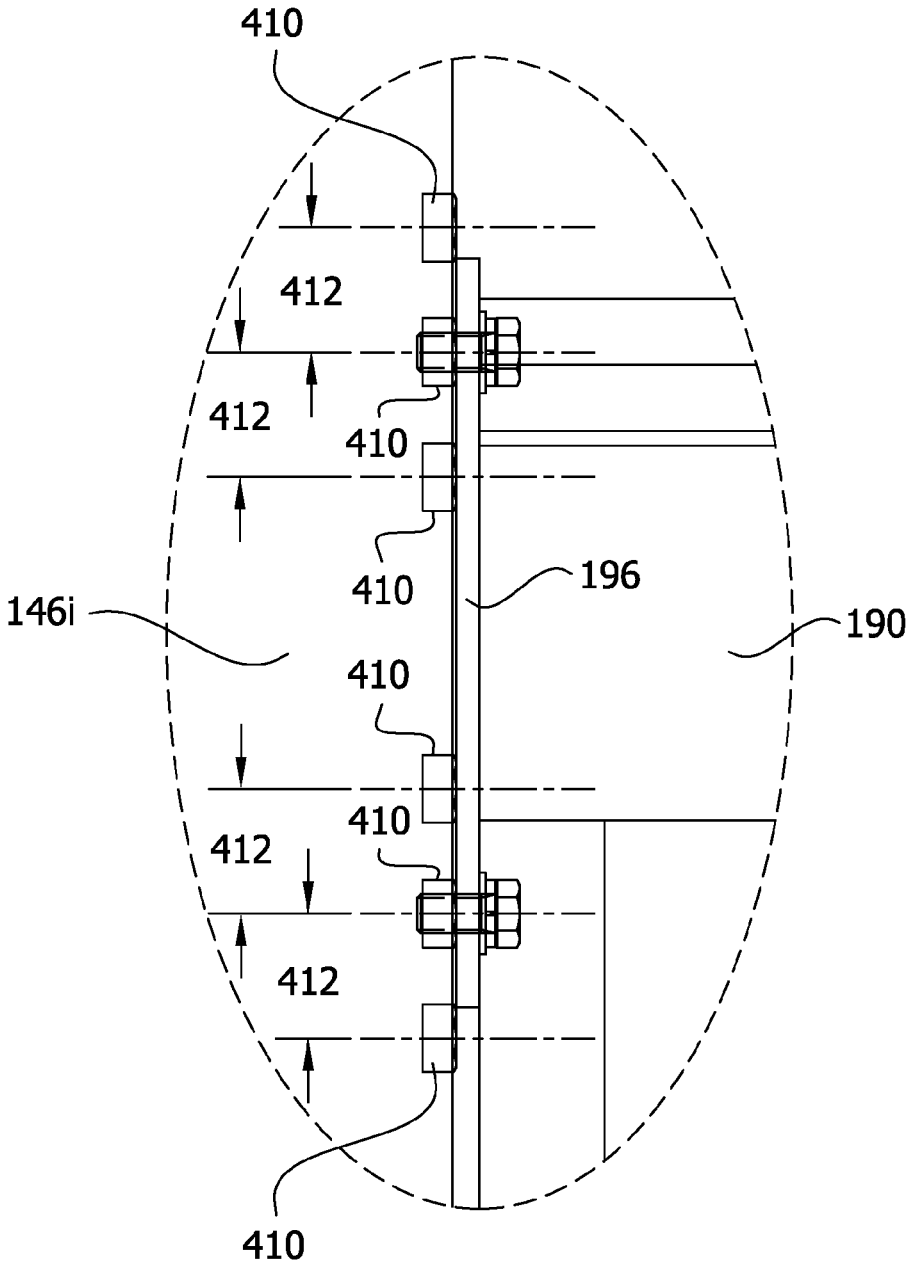
FIG. 42 is an enlarged portion of FIG. 41 showing multiple bolt-hole patterns spaced at intervals along a vertical beam of the conveyor belt aperture frame assembly to allow the upper horizontal frame member to be selectively attached at a selected one of several different vertical locations along the vertical beam.

Referring to FIGS. 41 and 42, the upper horizontal frame member 190 of the conveyor belt aperture frame assembly 120 can be bolted to the vertical beams 146*i*, 146J at different locations along the beams to allow for custom fitting of the frame assembly around a conveyor belt 106. To facilitate assembly, the vertical beams 146*i*, 146J have patterns of pre-drilled bolt holes 410 spaced at vertical intervals 412 along the beams. As a result, the upper horizontal frame member 190 of the conveyor belt aperture frame assembly 120 can be bolted to the two vertical beams 146*i*, 146J at a selected location tailored to fit a particular conveyor belt installation. By way of example only, three bolt-hole pattern locations spaced at two-inch intervals 412 to allow for different belt heights. More or fewer vertically-spaced locations can be provided. Optionally, the lower horizontal frame member 192 of the conveyor belt aperture frame assembly 120 can be bolted to the two vertical beams 146*i*, 146J at different locations tailored to fit a particular conveyor belt installation.

The multiple sets of pre-drilled bolt holes 400, 410 in the vertical beams 146*i*, 146J and in the horizontal roof and floor beams 140, 142 allows the frame assembly 120 to be positioned at different vertical and horizontal locations on the wall frame 116 depending on a desired location of the belt aperture 122, and further depending on the dimensions of the belt aperture. This feature facilitates field installation and custom fit of the frame assembly 120 around an existing (or planned) conveyor belt assembly 104.

Figure 43:
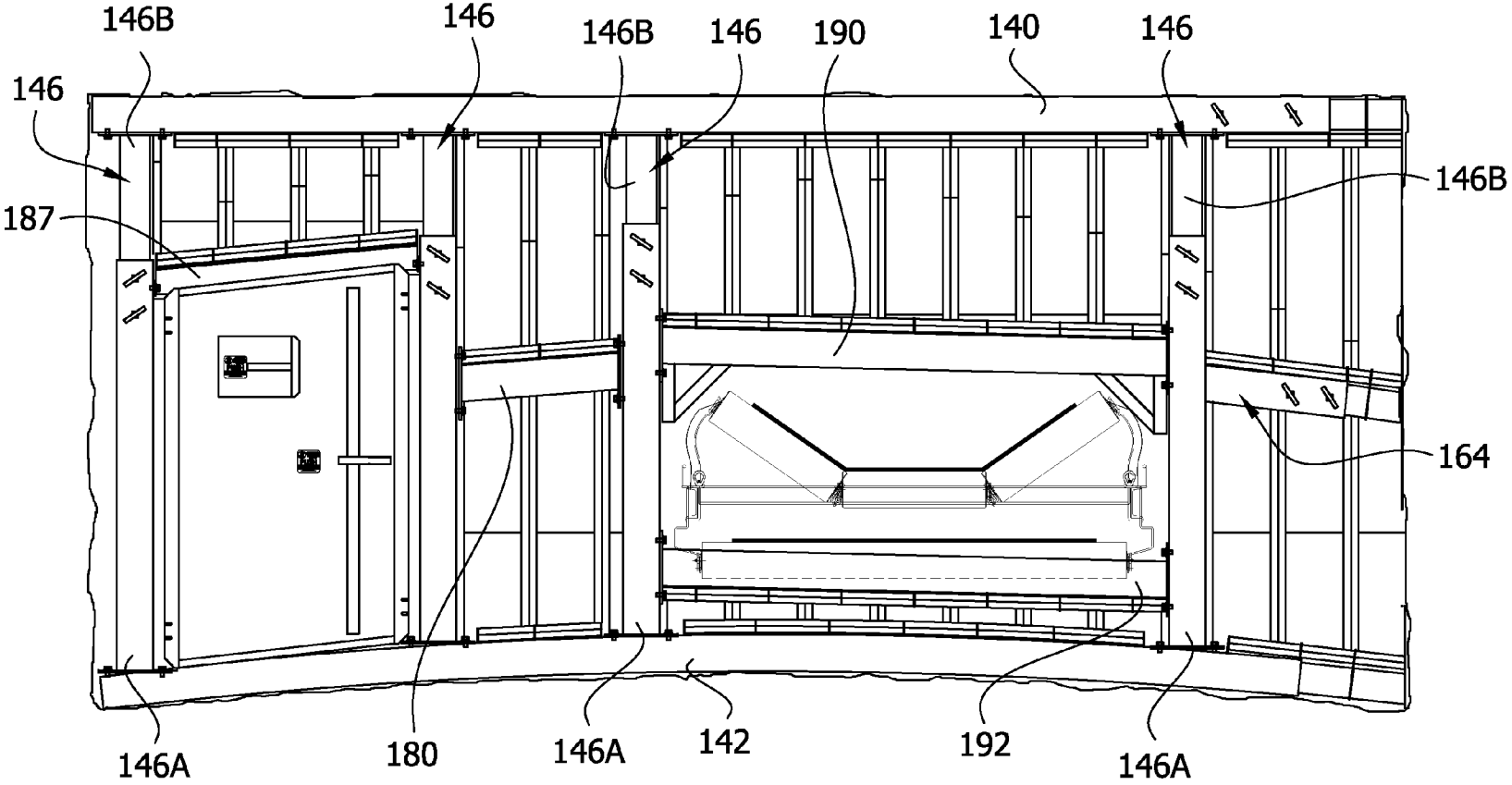
FIG. 43 is a front elevation of the box check illustrating the affect of a mine convergence (floor heaving) on a wall of the box check when the outer vertical beam members of respective vertical beams are bolted to the floor beam.
Figure 44:
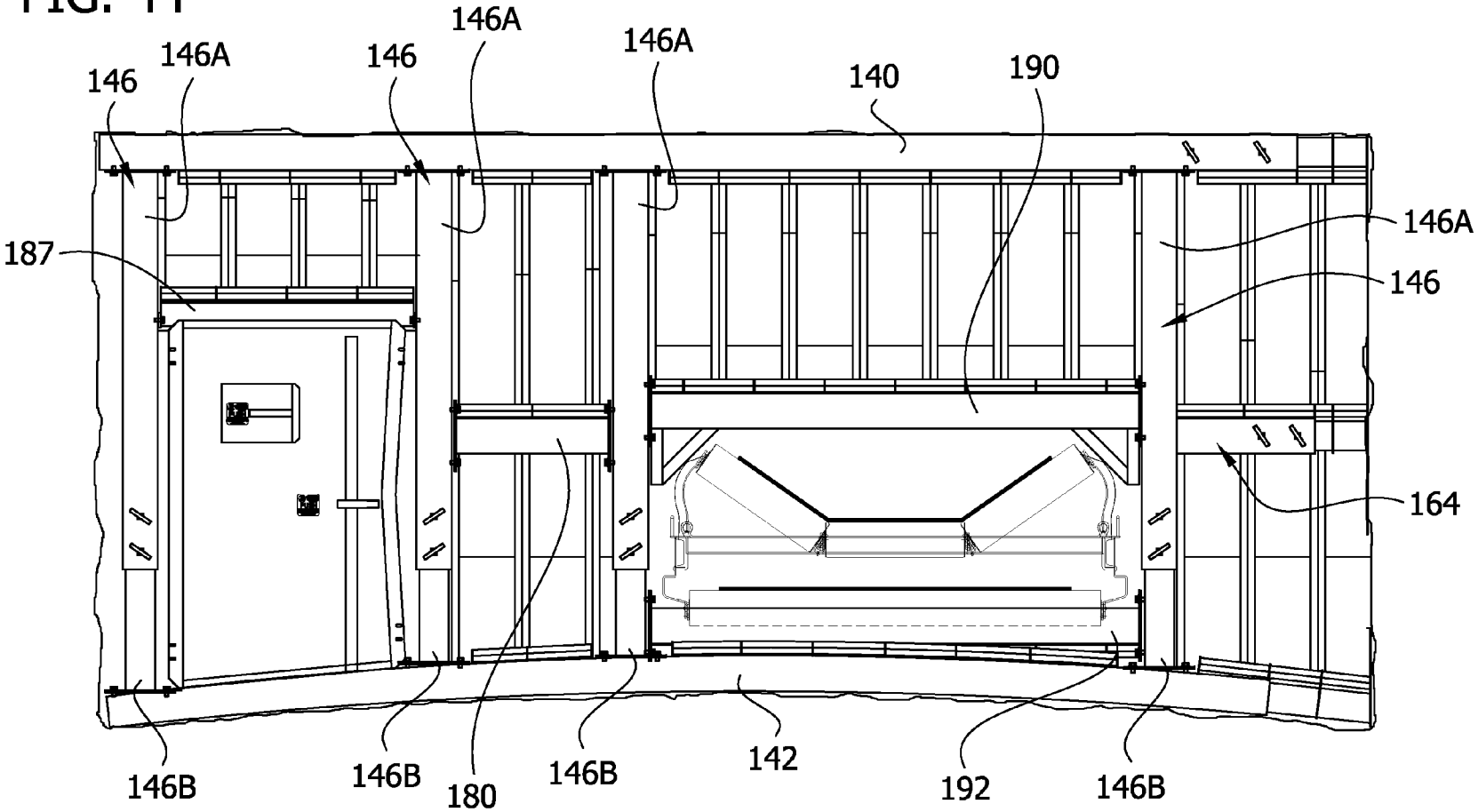
FIG. 44 is a front elevation of the box check illustrating the affect of a mine convergence (floor heaving) on a wall of the box check when the inner vertical beam members of respective vertical beams are bolted to the floor beam.

FIG. 43 illustrates the affect of a mine convergence (floor heaving) on a wall 108, 110 of the box check 110. In this embodiment, the lower vertical beam members 146A of respective vertical beams 146 are bolted to the floor beam 142, and the horizontal frame members 190, 192 of the conveyor belt aperture frame assembly are bolted to the lower vertical frame members 146A. As a result, the convergence of the floor toward the roof has the illustrated affect on the horizontal beams. In contrast, FIG. 44 illustrates an embodiment in which the vertical beams 146 are "upside down", that is, the inner (smaller-size) vertical beam members 146B are bolted to the floor beam 142. The upper horizontal frame member 190 of the conveyor belt aperture frame assembly is bolted to the outer (larger-size) vertical beam members 146A, and the lower horizontal frame member 192 of the conveyor belt aperture frame assembly is bolted to the inner (smaller-size) vertical beam members 146B. As a result, the same floor-to-roof convergence has no substantial affect on the horizontal beams 164, 180, 187, 190, 192 of the box check other than the floor beam 142.

It will be apparent from the foregoing that the box check 100 described above has many advantages. It drastically reduces belt air flow. It is adjustable to fit mine openings of different size. It can be built to any size or pressure rating required. It can be customized to fit any particular belt structure or heap height. It can be equipped with conventional man doors or escape way doors. It can be provided with an airlock for high pressure installations. It can be constructed in an entry with the conveyor belt already present. It can be equipped with an automatic gate to close the conveyor aperture when the belt is empty and stopped. Other advantages will be apparent from the above description.

Figure 45:
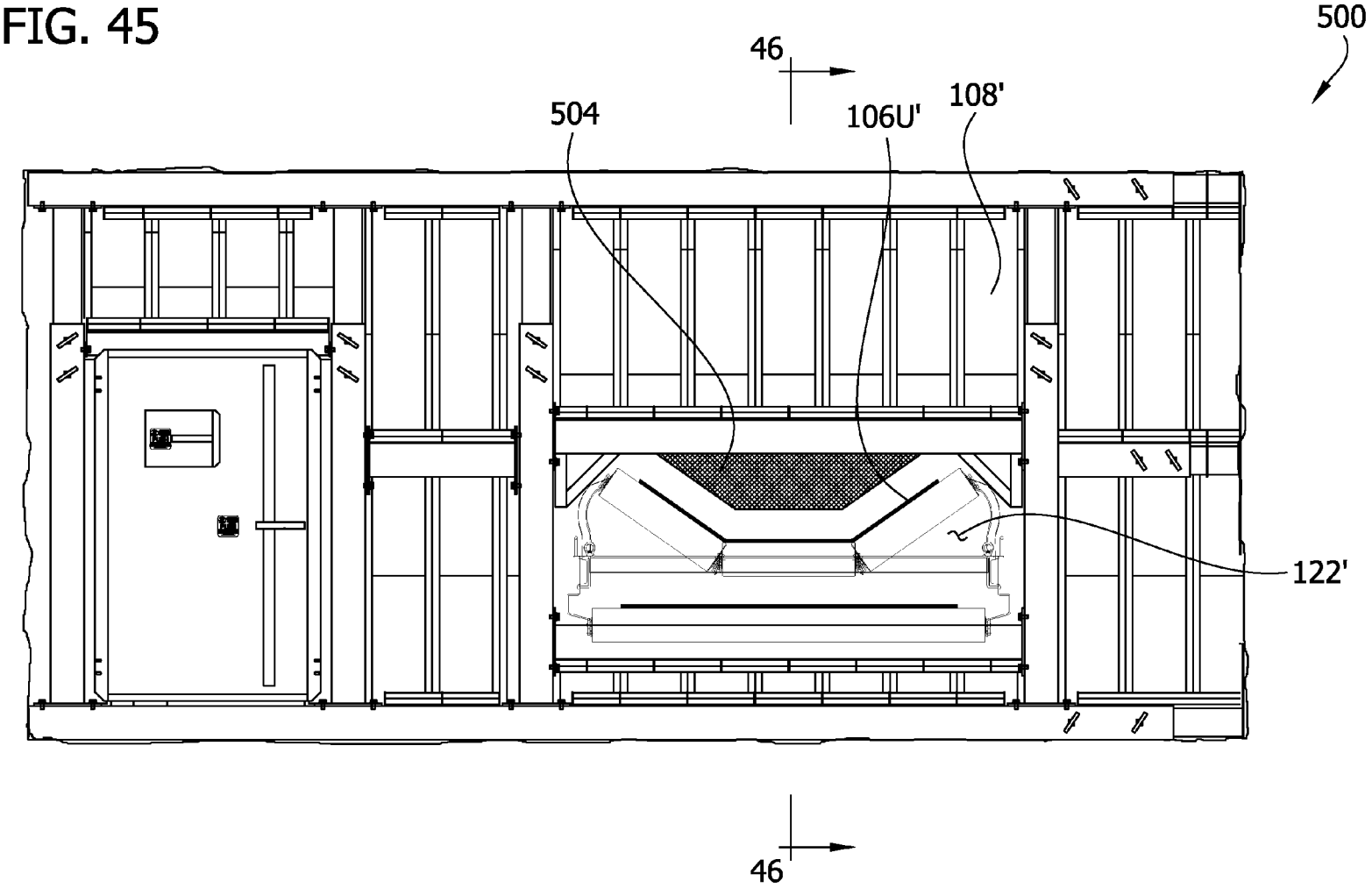
FIG. 45 is a front elevation of a box check of a second embodiment in which an electrically adjustable gate is provided for limiting air flow through the belt aperture when the conveyor belt has little or no load on it.
Figure 46:
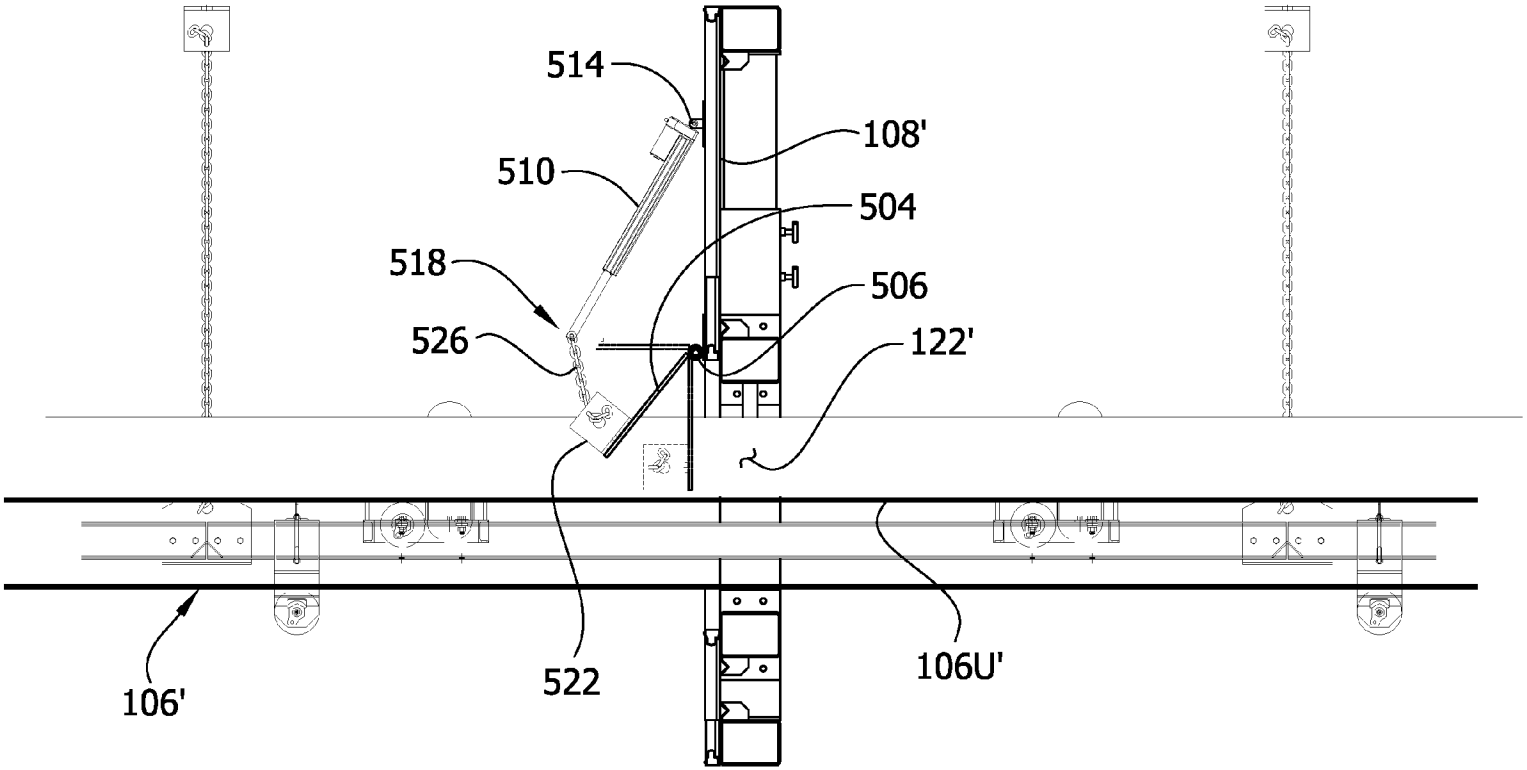
FIG. 46 is a vertical section taken in the plane of line 46-46 of FIG. 45.

FIGS. 45 and 46 illustrate a conveyor belt box check, generally designated 500, substantially identical to the box check 100 described above, and corresponding parts are indicated by corresponding reference numbers, with the addition of a prime (′). The box check 500 includes a gate 504 mounted for movement between an up position allowing material (e.g., coal) heaped up on the upper reach 106U′ of the conveyor belt 106′ to move through the belt aperture 122′ and a down position for limiting air flow through the belt aperture when the conveyor belt has little or no load on it. As illustrated in FIG. 46, the gate 504 is mounted by a hinge 506 secured to the wall 108′ for swinging movement between its up and down positions, an exemplary up position of the gate being shown in dashed lines as a generally horizontal position, an exemplary down position of the gate being shown in dashed lines as a generally vertical position, and an exemplary intermediate position of the gate between the up and down positions being shown in solid lines. The gate 504 comprises a panel or plate of suitable shape, such as a tapered shape generally conforming to the shape of the upper reach 106U′ of the conveyor belt.

The gate 504 is movable between the stated up and down positions by a power actuator 510, e.g., an electrically-powered extensible and retractable cylinder unit under the control of an operator. The actuator 510 has a connection 514 with the wall 108 and a connection 518 with the gate. In the illustrated embodiment, the connection 518 comprises a bracket 522 on the gate and a link 526 (e.g., a chain) connecting the bracket and the actuator 510 (e.g., the rod end of a cylinder unit). Desirably, the link 526 is flexible to allow limited up and down movement of the gate to accommodate (follow) variations in the height of the material heaped on the conveyor belt 106′.

Other types of power actuators and connections can be used to move the gate 504 between the stated up and down positions and to other selected positions of adjustment. By way of example, in an alternative embodiment the gate 504 is mounted for sliding movement of the gate in a generally vertical plane, and suitable means such as a cylinder unit is provided to move the gate up a and down to selected positions of vertical adjustment.

Figure 47:
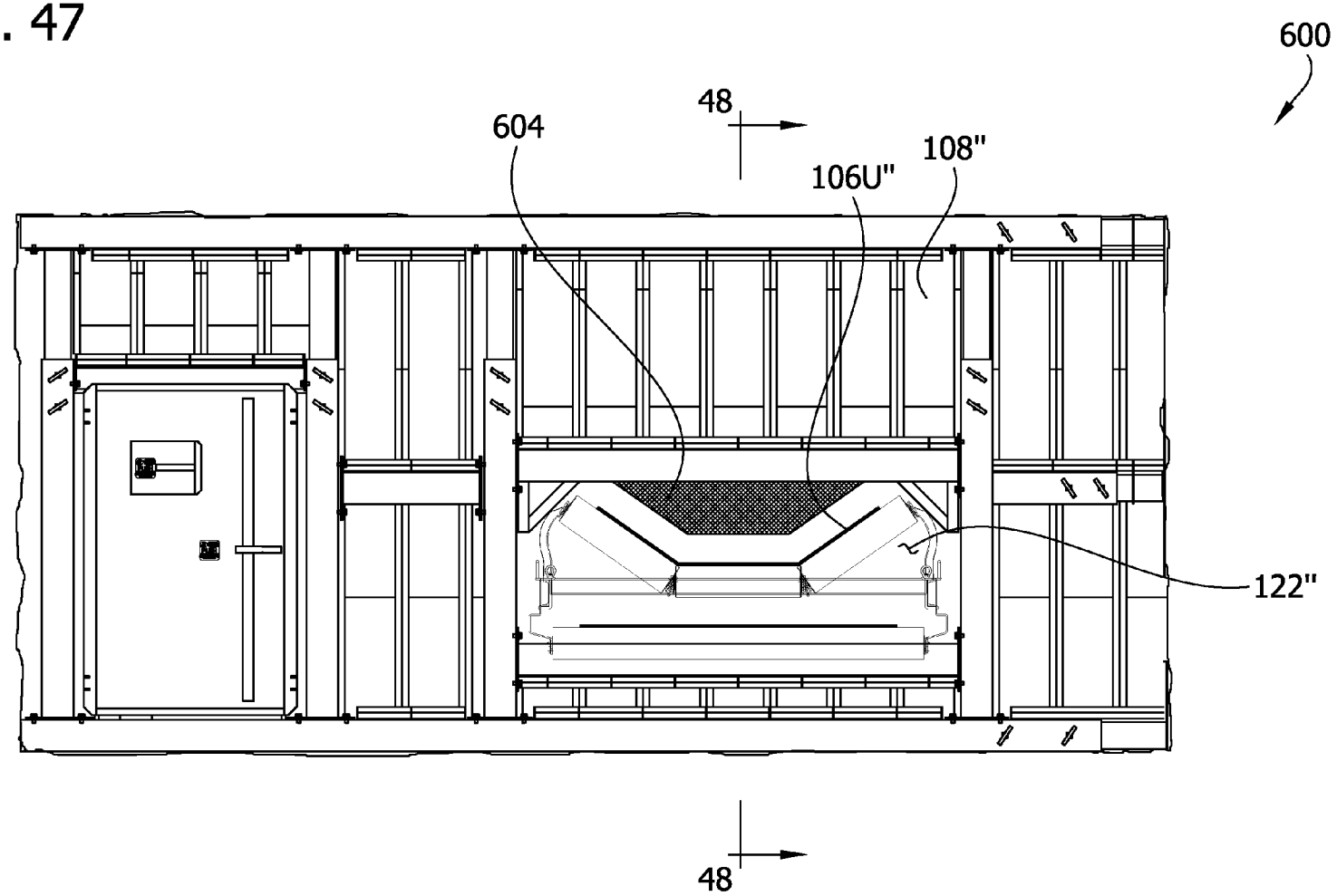
FIG. 47 is a front elevation of a box check of a third embodiment in which an electrically adjustable gate is provided for limiting air flow through the belt aperture when the conveyor belt has little or no load on it.
Figure 48:
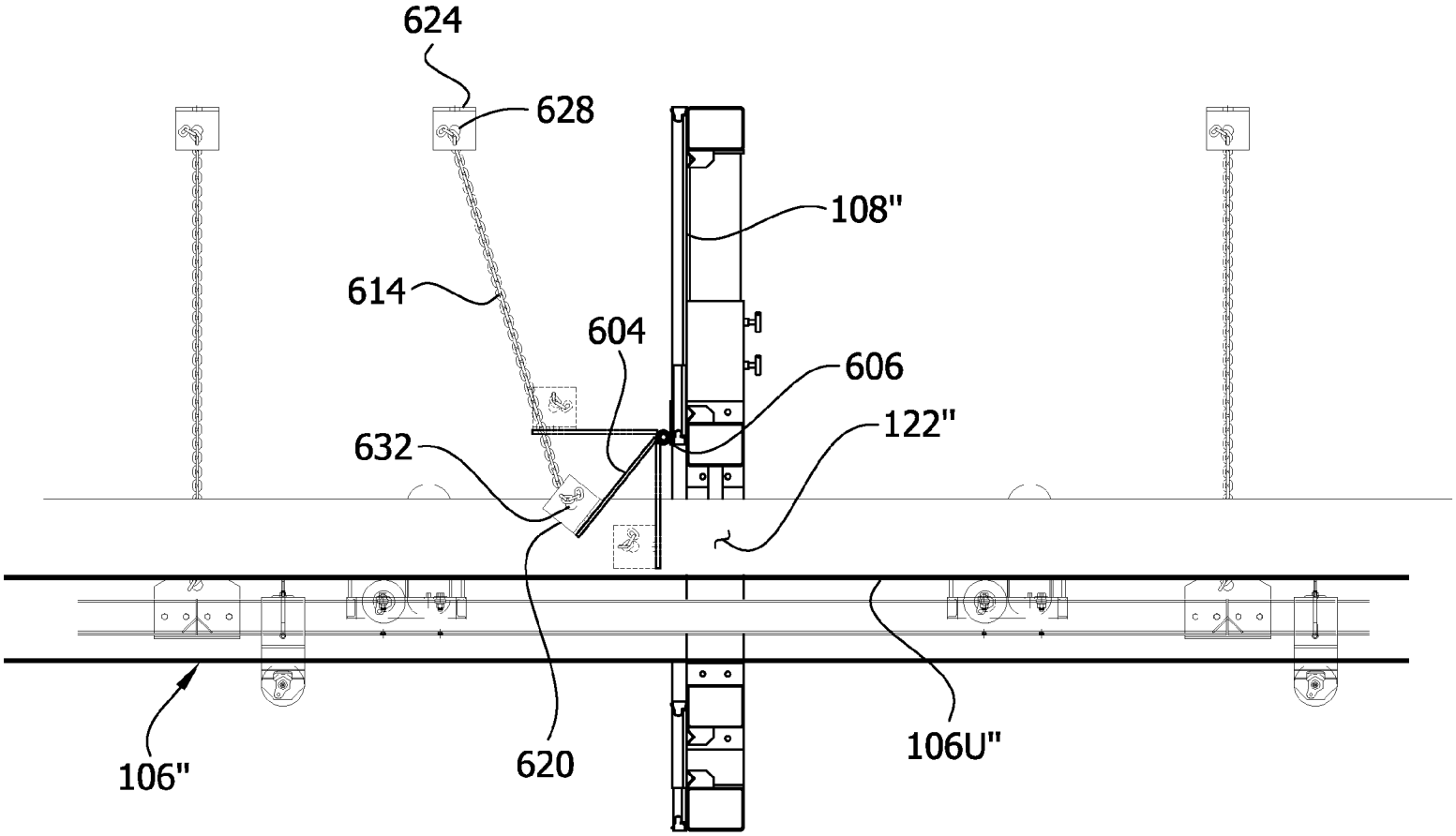
FIG. 48 is a vertical section taken in the plane of line 48-48 of FIG. 47.

FIGS. 47 and 48 illustrate a conveyor belt box check, generally designated 600, substantially identical to the box check 100 described above, and corresponding parts are indicated by corresponding reference numbers, with the addition of a double prime (″). The box check 600 includes a gate 604 mounted for movement between an up position allowing material (e.g., coal) heaped up on the upper reach 106U″ of the conveyor belt 106″ to move through the belt aperture 122″ and a down position for limiting air flow through the belt aperture when the conveyor belt has little or no load on it. In the embodiment of FIG. 46, the gate 604 is mounted by a hinge 606 secured to the wall 108″ for swinging movement between its up and down positions, an exemplary up position of the gate being shown in dashed lines as a generally horizontal position, an exemplary down position of the gate being shown in dashed lines as a generally vertical position, and an exemplary intermediate position of the gate between the up and down positions being shown in solid lines. The gate 604 comprises a panel or plate of suitable shape, such as a tapered shape generally conforming to the shape of the upper reach 106U″ of the conveyor belt.

The gate 604 is movable between the stated up and down positions by a manually operated device 610 which, in this embodiment, comprises a link 614 (desirably a flexible link such as a chain) connected to a suitable support or anchor 624 and to the gate 604 by suitable means such as a bracket 620 affixed to the gate. The link 614 is used by an operator to manually raise and lower the gate 604 to a desired position. The link 614 is then secured to hold the gate in the desired position. By way of example, if the link 614 is a chain, the links of the chain can be moved through a key-hole opening 628 in the anchor 624 and/or a key-hole opening 632 in the bracket 620 until the gate 604 is in the desired position, at which point the links in or adjacent respective openings 628, 632 are manipulated in either opening or both openings to lock the chain (and gate) in position until a further adjustment of the position of the gate is needed or desired. Desirably, after the gate 604 is fixed in the desired position, the flexibility of the link 526 allows up and down movement of the gate to accommodate (follow) variations in the height of the material heaped on the conveyor belt 106′.

Other types of manually operated devices and connections can be used to move the gate 604 between the stated up and down positions and to other selected positions of adjustment. By way of example, in an alternative embodiment the gate 604 is mounted for sliding movement of the gate in a generally vertical plane, and suitable means such as a manually operated device is provided to move the gate up and down to selected vertical positions of adjustment.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A box check for a conveyor belt installed in a mine, the box check comprising first and second generally parallel spaced-apart walls extending across a mine passage, the first wall being closer to a mouth of the mine and the second wall being farther away from the mouth of the mine, each of the first and second walls comprising:

a wall frame including horizontal roof and floor beams, and stopping panels secured to the wall frame for stopping open areas between the horizontal roof and floor beams; and a conveyor belt aperture frame assembly on the wall frame at least partially defining a conveyor belt aperture for receiving the conveyor belt.

2. The box check of claim 1, further comprising an access door in each of the first and second walls.

3. The box check of claim 2, further comprising a partition extending between the first and second walls for separating the access doors from the conveyor belt aperture and for forming an air lock between the walls.

4. The box check of claim 3, wherein the partition comprises a partition frame affixed to the wall frames of the first and second walls.

5. The box check of claim 4, wherein the partition frame comprises a roof beam attached to the roof beams of the first and second walls, and a floor beam attached to the floor beams of the first and second walls.

6. The box check of claim 5, wherein the partition frame comprises at least one length-adjustable vertical beam.

7. The box check of claim 3, further comprising an access door in the partition for accessing the conveyor belt from the air lock.

8. The box check of claim 1, wherein at least some of the stopping panels are telescoping panels allowing lengths of the telescoping panels to be adjusted to fit said open areas, said box check further comprising a gate on the conveyor belt aperture frame assembly movable between an up position allowing product heaped up on the conveyor to move through the belt aperture and a down position for limiting air flow through the belt aperture when the conveyor belt has less or no product on it.

9. The box check of claim 1, further comprising multiple pre-drilled bolt holes on the wall frame allowing positioning of the conveyor belt aperture frame assembly at different locations on the wall frame depending on a desired location of the conveyor belt aperture in the wall.

10. The box check of claim 9, wherein the multiple pre-drilled bolt holes allow the conveyor belt aperture frame assembly to be positioned at different horizontal locations on the wall frame.

11. The box check of claim 10, wherein the multiple pre-drilled bolt holes allow the conveyor belt aperture frame assembly to be positioned at different vertical locations on the wall frame.

12. The box check of claim 1, wherein said conveyor belt aperture frame assembly comprises two vertical beams, a first horizontal frame member extending between the two vertical beams, and a second horizontal frame member extending between the two vertical beams at a location spaced below the first horizontal frame member, the two vertical beams and the first and second horizontal frame members framing the conveyor belt aperture.

13. The box check of claim 12, wherein each of the roof and floor beams has multiple pre-drilled bolt holes spaced along the beam for bolting the two vertical beams to the roof and floor beams at different horizontal locations along the roof and floor beams to vary the horizontal position or horizontal dimension of the conveyor belt aperture.

14. The box check of claim 12, wherein each of the two vertical beams has multiple pre-drilled bolt holes spaced along the beam for bolting the first and second horizontal frame members to the vertical beams at different vertical locations along the vertical beams to vary the vertical position or vertical dimension of the conveyor belt aperture.

15. The box check of claim 1, wherein said roof and floor beams are length adjustable.

16. The box check of claim 1, wherein said wall frame includes length-adjustable vertical beams extending between the roof and floor beams.

17. A box check for a conveyor belt installed in a mine, the box check comprising first and second generally parallel spaced-apart walls extending across a mine passage, each for the first and second walls having a conveyor belt aperture sized for receiving the conveyor belt, access doors in the first and second walls, and a partition extending between the first and second walls for separating the access doors from the conveyor belt apertures and for forming an air lock between the walls.

18. The box check of claim 17, wherein the partition comprises a partition frame affixed to wall frames of the first and second walls, respectively.

19. The box check of claim 18, wherein the partition frame comprises a roof beam attached to roof beams of the first and second wall frames, and a floor beam attached to floor beams of the first and second wall frames.

20. The box check of claim 18, wherein the partition frame comprises at least one length-adjustable vertical beam.

21. The box check of claim 17, further comprising an access door in the partition for accessing the conveyor belt from the air lock.

22. The box check of claim 17, further comprising a gate on at least one of the first and second walls adjacent a respective conveyor belt aperture, the gate being movable between an up position allowing product heaped up on the conveyor to move through the respective belt aperture and a down position for limiting air flow through the respective belt aperture when the conveyor belt has less or no product on it.

23. The box check of claim 17, wherein each of the first and second walls comprises a wall frame including telescopically adjustable horizontal roof and floor beams and telescopically adjustable vertical beams extending between the roof and floor beams.

24. A method of installing a box check for a conveyor belt in a mine passage, comprising installing first and second generally parallel spaced-apart walls to extend across a mine passage, characterized in that the installing comprises, for each of the first and second walls:

telescopically adjusting horizontal roof and floor beams to fit a width of the mine passage;

anchoring the roof and floor beams to a roof and floor of the mine passage, respectively;

telescopically adjusting vertical beams to extend between the roof and floor beams to fit a height of the mine passage;

bolting two of the vertical beams to the roof and floor beams at selected horizontally-spaced locations on opposite sides of a vertical centerline of the conveyor belt; and bolting horizontal frame members to the two vertical beams such that the frame members extend between the vertical beams at selected vertically-spaced locations to provide a conveyor belt aperture in the wall between the two vertical beams and between the horizontal frame members.

25. The method of claim 24, further comprising installing access doors in the first and second walls.

26. The method of claim 25 further comprising installing a partition between the first and second walls for separating the access doors from the conveyor belt apertures and for forming an air lock between the walls.

27. The method of claim 24, wherein each of the horizontal roof and floor beams has pre-drilled bolt holes spaced at horizontal intervals along the beam, and wherein the vertical frame members are bolted to the roof and floor beams using selected pre-drilled bolt holes to position the conveyor belt aperture at a desired horizontal position.

28. The method of claim 24, wherein each of the two vertical beams has pre-drilled bolt holes spaced at vertical intervals along the beam, and wherein the horizontal frame members are bolted to the two vertical beams using selected pre-drilled bolt holes to position the conveyor belt aperture at a desired vertical position.

* * * * *